US009897937B2

(12) United States Patent
Jung et al.

(10) Patent No.: US 9,897,937 B2
(45) Date of Patent: Feb. 20, 2018

(54) DEVELOPMENT CARTRIDGE AND ELECTROPHOTOGRAPHIC IMAGE FORMING APPARATUS USING THE SAME

(71) Applicant: S-PRINTING SOLUTION CO., LTD., Suwon-si, Gyeonggi-do (KR)

(72) Inventors: Tae-il Jung, Suwon-si (KR); Sung-dae Kim, Suwon-si (KR); Tae-hee Kim, Yongin-si (KR); Pil-seung Oh, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/361,961

(22) Filed: Nov. 28, 2016

(65) Prior Publication Data

US 2017/0184999 A1 Jun. 29, 2017

(30) Foreign Application Priority Data

Dec. 23, 2015 (KR) ..... 10-2015-0185095

(51) Int. Cl.
*G03G 15/08* (2006.01)

(52) U.S. Cl.
CPC ..... *G03G 15/0865* (2013.01)

(58) Field of Classification Search
CPC ..... G03G 21/1825; G03G 21/1857; G03G 21/1821; G03G 21/185; G03G 15/0813;
(Continued)

(56) References Cited

U.S. PATENT DOCUMENTS 7,194,225 B2 3/2007 Yamaguchi
7,542,701 B2 6/2009 Kweon
(Continued)

FOREIGN PATENT DOCUMENTS

JP 1998-036035 8/1998
JP 11-52728 2/1999
(Continued)

OTHER PUBLICATIONS

Korean Notice of Allowance dated Feb. 6, 2017 from Korean Patent Application No. 10-2015-0185095, 8 pages.
(Continued)

*Primary Examiner* — Clayton E Laballe
*Assistant Examiner* — Ruifeng Pu
(74) *Attorney, Agent, or Firm* — Staas & Halsey LLP

(57) ABSTRACT

A development cartridge attachable to and detachable from a main body of an image forming apparatus includes a photosensitive unit including a photosensitive drum, a developing unit including a developing roller and rotatably coupled to the photosensitive unit with respect to a hinge axis, a driving gear configured to rotate in a first direction for a printing operation or a second direction opposite the first direction, a driving member positioned coaxially with the driving gear and configured to be rotated by the driving gear, a first one-way clutch configured to connect the driving member with the driving gear only when the driving gear rotates in the second direction, and a first moving member configured to be connected to the driving member so as to reciprocate between a first location where a development nip is formed and a second location where the development nip is released.

20 Claims, 15 Drawing Sheets

(58) Field of Classification Search
CPC ..... G03G 15/0898; G03G 15/2053; G03G 15/757; G03G 21/1647; G03G 21/1853; G03G 2221/163; G03G 2221/1654; G03G 2221/1684; G03G 2221/1657
See application file for complete search history.

(56) References Cited

U.S. PATENT DOCUMENTS

| | | | | |
|---|---|---|---|---|
| 7,715,756 | B2 | 5/2010 | Hattori | |
| 8,170,447 | B2 | 5/2012 | Kubo et al. | |
| 8,503,907 | B2 | 8/2013 | Ji et al. | |
| 8,670,690 | B2 | 3/2014 | Jang et al. | |
| 8,699,912 | B2 | 4/2014 | Kim et al. | |
| 8,794,413 | B2 | 8/2014 | Ishikawa | |
| 9,235,176 | B2 * | 1/2016 | Takahashi | G03G 15/2064 |
| 9,783,365 | B2 * | 10/2017 | Uesugi | B65G 13/06 |
| 2008/0190242 | A1 * | 8/2008 | Kim | G03G 15/757 74/84 R |
| 2011/0280621 | A1 * | 11/2011 | Suzuki | G03G 21/1821 399/111 |
| 2015/0003871 | A1 * | 1/2015 | Takahashi | G03G 15/2064 399/122 |
| 2015/0117918 | A1 | 4/2015 | Suzuki | |
| 2015/0212456 | A1 * | 7/2015 | Imaizumi | G03G 21/1647 74/665 G |
| 2015/0212466 | A1 * | 7/2015 | Fukunaga | G03G 15/2064 399/122 |
| 2016/0070199 | A1 * | 3/2016 | Oh | F16H 1/20 399/258 |

FOREIGN PATENT DOCUMENTS

| | | |
|---|---|---|
| JP | 2006-267602 | 10/2006 |
| JP | 2007-24973 | 2/2007 |
| JP | 2007-178656 | 7/2007 |
| JP | 2009-47845 | 3/2009 |
| JP | 2010-243804 | 10/2010 |
| JP | 2011-191403 | 9/2011 |
| JP | 2014-16432 | 1/2014 |
| JP | 2014-164173 | 9/2014 |
| KR | 10-0693338 | 3/2007 |
| KR | 10-2007-0037888 | 4/2007 |
| KR | 10-2010-0132755 | 12/2010 |
| KR | 10-2012-0079937 | 7/2012 |

OTHER PUBLICATIONS

International Search Report and Written Opinion of the International Searching Authority dated Feb. 27, 2017, 9 pages.
Extended European Search Report dated May 9, 2017 in corresponding European Patent Application No. 16203660.2.

* cited by examiner

DEVELOPMENT CARTRIDGE AND ELECTROPHOTOGRAPHIC IMAGE FORMING APPARATUS USING THE SAME

CROSS-REFERENCE TO RELATED APPLICATIONS

This application claims the priority benefit of Korean Patent Application No. 10-2015-0185095, filed on Dec. 23, 2015, in the Korean Intellectual Property Office, the disclosure of which is incorporated herein in its entirety by reference.

BACKGROUND

1. Field

The disclosure is related to an electrophotographic image forming apparatus for forming an image onto a recording medium in an electrophotographic manner, and a development cartridge capable of being detachably attached to the electrophotographic image forming apparatus.

2. Description of the Related Art

An electrophotographic image forming apparatus operating in an electrophotographic manner prints an image onto a recording medium by forming a visible toner image on a photosensitive body by supplying a toner to an electrostatic latent image formed on the photosensitive body, transferring the toner image to the recording medium, and fixing the transferred toner image to the recording medium.

A development cartridge is an assembly of elements for forming the visible toner image. The development cartridge is detachably attached to a main body of the image forming apparatus and is a consumable item to be replaced when its service life is over. In a development cartridge using a contact development manner, a developing roller and the photosensitive body contact each other and thus form a development nip.

When a long time elapses after the development nip is formed, the developing roller may be deformed and the photosensitive body may be damaged. The deformation of the developing roller and the damage of the photosensitive body may cause a change of the development nip, which reduces the image quality.

SUMMARY

Additional aspects and/or advantages will be set forth in part in the description which follows and, in part, will be apparent from the description, or may be learned by practice of the disclosure.

Provided are a development cartridge having a simple development nip detachment structure, and an electrophotographic image forming apparatus employing the development cartridge.

Provided are a development cartridge having a durability-improved development nip detachment structure, and an electrophotographic image forming apparatus employing the development cartridge.

Provided are a development cartridge having a driving noise-reduced development nip detachment structure, and an electrophotographic image forming apparatus employing the development cartridge.

Additional aspects will be set forth in part in the description which follows and, in part, will be apparent from the description, or may be learned by practice of the disclosed embodiments.

According to an aspect of an embodiment, a development cartridge for an image forming apparatus may includes a photosensitive unit comprising a photosensitive drum; a developing unit comprising a developing roller configured to contact the photosensitive drum so as to form a development nip, the developing unit coupled to the photosensitive unit to be rotatable; a driving gear configured to drive at least one of the developing roller and the photosensitive drum, and configured to rotate in a first direction or a second direction opposite the first direction; a driving member positioned coaxially with the driving gear and configured to be rotated by the driving gear; a first one-way clutch configured to connect the driving member with the driving gear when the driving gear rotates in the second direction; and a first moving member configured to be connected to the driving member so as to move between a first location to rotate the developing unit to form the development nip and a second location to rotate the developing unit to release the development nip.

The driving gear may be configured to be rotated in the first direction during a printing operation, and to be rotated in the second direction during a non-printing operation.

The driving member may include pinion gear parts, and the first moving member comprises rack gear parts to be engaged with the pinion gear parts.

When the first moving member moves from the first location to the second location, the first moving member may rotate the developing unit in a direction to cause the development nip to be released, and when the first moving member moves from the second location to the first location, the first moving member may allow the developing unit to rotate in a direction to cause the development nip to be formed.

The development cartridge may further include an elastic member configured to provide an elastic force by which the developing unit rotates to form the development nip, and wherein, when the driving gear rotates in the first direction, the first moving member may move from the second location to the first location due to the elastic force of the elastic member.

The driving gear and the driving member may be disposed at the development nip, and when the first moving member moves from the first location to the second location, the first moving member may move the photosensitive unit by contacting a contact part of the photosensitive unit.

The driving gear and the first moving member may be disposed at the photosensitive unit, and when the first moving member moves from the first location to the second location, the first moving member may move the developing unit by contacting a contact part of the developing unit.

A speed reducer may be disposed between the driving gear and the driving member. The speed reducer comprises a planetary reducer.

The planetary reducer may include a sun gear configured to be rotated by the driving gear, and a plurality of planet gears configured to be engaged with the sun gear and to be rotatably mounted at the driving member, and the driving gear and the sun gear may be connected to each other by the first one-way clutch.

The photosensitive unit may include a first rotational member comprising the photosensitive drum, the developing unit may include a second rotational member comprising the developing roller, and the driving gear and the driving member may be mounted on a rotation axis of one of the first rotational member and the second rotational member.

The driving gear may be rotatably mounted on a rotation axis of the developing roller, and the development cartridge may further include a driving bush coupled to the rotation axis of the developing roller, and a second one-way clutch configured to connect the driving gear with the driving bush when the driving gear rotates in the first direction.

The photosensitive unit may include a first rotational member comprising the photosensitive drum, the developing unit may include a second rotational member comprising the developing roller, and the driving gear and the driving member may be mounted on an axis other than rotation axes of the first rotational member and the second rotational member.

The development cartridge may further include a charging roller configured to form a charging nip by contacting the photosensitive drum and to charge the photosensitive drum; a second elastic member configured to apply an elastic force to the charging roller in a direction to cause the charging roller to contact the photosensitive drum; and a second moving member disposed at the photosensitive unit so as to be moved, by the driving member, between a charging position to form the charging nip and a non-charging position to space the charging roller apart from the photosensitive drum.

The second moving member may be configured to move from the charging position to the non-charging position when the first moving member is moved from the first location to the second location.

The development cartridge may further include an extending part disposed at the developing unit and configured to move the second moving member to the non-charging position when the first moving member is moved from the first location to the second location.

The development cartridge may further include a third elastic member configured to apply an elastic force to the second moving member in a direction to cause the second moving member to return to the charging position when the first moving member is moved from the second location to the first location.

According to an aspect of another embodiment, an electrophotographic image forming apparatus may include: a main body, and the development cartridge above, the development cartridge capable of being detachably attached to the main body.

The electrophotographic image forming apparatus may further include a driving motor disposed at the main body and configured to drive the photosensitive drum and the developing roller; and a second one-way clutch disposed between the driving motor and the photosensitive drum so as to connect the driving motor with the photosensitive drum when the driving gear rotates in the first direction.

The electrophotographic image forming apparatus may further include a first driving motor disposed at the main body and configured to drive the photosensitive drum; and a second driving motor disposed at the main body and configured to drive the developing roller.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
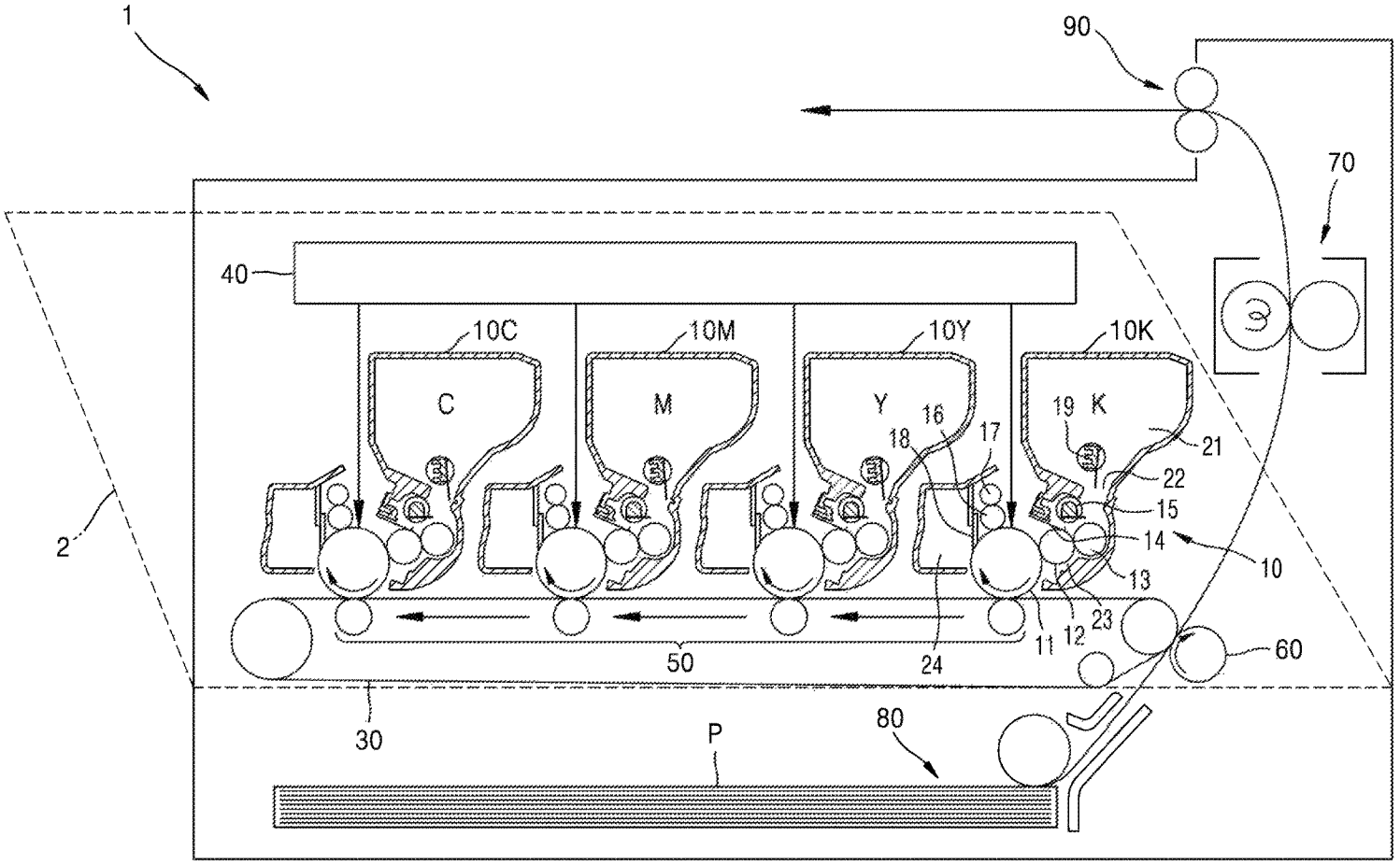
FIG. 1 is a schematic configuration diagram illustrating an electrophotographic image forming apparatus, according to an embodiment.

Reference will now be made in detail to example embodiments which are illustrated in the accompanying drawings, wherein like reference numerals refer to like elements throughout. The embodiments are described below to explain the disclosure by referring to the figures.

The disclosure will be described in detail by explaining embodiments of an electrophotographic image forming apparatus and a development cartridge with reference to the attached drawings. Throughout the specification and drawings, those elements performing substantially the same function are rendered the same reference numeral, and redundant explanations thereof are omitted. As used herein, the term "and/or" includes any and all combinations of one or more of the associated listed items. Expressions such as "at least one of," when preceding a list of elements, modify the entire list of elements and do not modify the individual elements of the list.

FIG. 1 is a schematic configuration diagram illustrating an electrophotographic image forming apparatus, according to an embodiment. The electrophotographic image forming apparatus (also referred to as the image forming apparatus) according to the embodiment prints a color image, according to an electrophotographic manner.

Referring to FIG. 1, the image forming apparatus may include a main body 1 and a plurality of development cartridges 10 detachably attached to the main body 1. For example, a front surface of the main body 1 may be open by opening a door 2, and the plurality of development cartridges 10 may be mounted to or detached from the main body 1. Although not illustrated, the door 2 may open or close a side surface or a top surface of the main body 1.

The plurality of development cartridges 10 may include development cartridges 10C, 10M, 10Y, and 10K for respectively developing toners of a cyan color (C), a magenta color (M), a yellow color (Y), and a black color (B). However, the scope of the disclosure is not limited thereto, and the image forming apparatus may further include development cartridges 10 for developing toners of other various colors such as a light magenta color, a white color, or the like. Hereinafter, the image forming apparatus including the development cartridges 10C, 10M, 10Y, and 10K will now be described, and unless there is a particular description contrary thereto, items with reference numerals C, M, Y, and K indicate elements for developing toners with a cyan color, a magenta color, a yellow color, and a black color.

Each of the development cartridges 10 may include a toner container 21 and a developing section 23. A toner contained in the toner container 21 is supplied to the developing section 23 through a supply hole 22. The toner container 21 may include a stirring member 19 for stirring the toner and supplying the toner to the developing section 23. The developing section 23 may include a photosensitive drum 11 on which an electrostatic latent image is formed, and a developing roller 12 for developing a visible toner image by supplying a toner of the developing section 23 to the electrostatic latent image. The photosensitive drum 11, as a photosensitive body on which an electrostatic latent image is formed, may include a conductive metal pipe and a photosensitive layer formed at its outer circumference.

A surface of the photosensitive drum 11 is charged by a charger so as to have a uniform surface potential. A charging roller 16 is an example of the charger. Instead of the charging roller 16, a charging brush, a corona charger, or the like may be used. The development cartridge 10 may further include a charging roller cleaner 17 for removing foreign substances such as toners, dusts, or the like attached to the charging roller 16. The charging roller cleaner 17 may be a roller that rotates while contacting the charging roller 16.

The development cartridge 10 may further include a cleaning member 18 and a waste toner container 24, wherein the cleaning member 18 removes residual toners on the surface of the photosensitive drum 11 after an intermediate transfer process to be described below, and the waste toner container 24 contains the toners removed from the photosensitive drum 11.

The developing roller 12 supplies a toner to the surface of the photosensitive drum 11 while the developing roller 12 rotates and contacts the photosensitive drum 11. A supply roller 13 for supplying a toner in the developing section 23 to the developing roller 12 may be arranged in the developing section 23. A regulation member 14 regulates an amount of toner to be supplied to a development area where the photosensitive drum 11 and the developing roller 12 face each other. A development stirring member 15 for stirring a toner in the developing section 23 may be further arranged in the developing section 23. In the embodiment, the development stirring member 15 and the stirring member 19 may have a same form.

The development cartridge 10 in the embodiment is integral type development cartridge in which the toner container 21, the developing section 23, and the waste toner container 24 are integrated as one body.

An exposure device 40 forms the electrostatic latent image on the photosensitive drum 11 by irradiating light to the photosensitive drum 11, the light being modulated according to image information. Examples of the exposure device 40 may include a laser scanning unit (LSU) using a laser diode as a light source, a light emitting diode (LED) exposure device using an LED as a light source, or the like.

An intermediate transfer belt 30 temporarily has a toner image developed on the photosensitive drum 11 of each of the development cartridges 10C, 10M, 10Y, and 10K. A plurality of intermediate transfer rollers 50 are positioned to face the photosensitive drums 11 of the development cartridges 10C, 10M, 10Y, and 10K by interposing the intermediate transfer belt 30 therebetween. An intermediate transfer bias voltage is applied to the plurality of intermediate transfer rollers 50 so as to intermediately transfer toner images, which are developed on the photosensitive drums 11, to the intermediate transfer belt 30. Instead of the intermediate transfer roller 50, a corona transfer device or a pin scorotron-type transfer device may be used.

A transfer roller 60 is positioned to face the intermediate transfer belt 30. A transfer bias voltage is applied to the transfer roller 60 so as to transfer, to a recording medium P, the toner image that is transferred to the intermediate transfer belt 30.

In the embodiment, it is described that the image developed on the photosensitive drums 11 is intermediately transferred to the intermediate transfer belt 30, and then is transferred to the recording medium P that passes through a nip between the intermediate transfer belt 30 and the transfer roller 60, but the disclosure is not limited thereto. That is, the recording medium P may directly pass through a nip between the intermediate transfer belt 30 and the photosensitive drums 11 so that the developed image may be directly transferred to the recording medium P. In this case, the transfer roller 60 is not employed.

A fixer 70 fixes the toner image onto the recording medium P by applying heat and/or a pressure to the toner image transferred to the recording medium P. A form of the fixer 70 is not limited to the embodiment of FIG. 1.

An image forming procedure according to the aforementioned configuration will now be briefly described.

The charging roller 16 charges the photosensitive drums 11 of the development cartridges 10C, 10M, 10Y, and 10K to have a uniform surface potential.

The exposure device 40 forms electrostatic latent images on the photosensitive drums 11 by scanning lights to the photosensitive drums 11 of the development cartridges 10C, 10M, 10Y, and 10K, the lights being modulated according to a plurality of pieces of image information of colors. The electrostatic latent images of the photosensitive drums 11 of the development cartridges 10C, 10M, 10Y, and 10K are developed to visible toner images due to C, M, Y, and K toners in the development cartridges 10C, 10M, 10Y, and 10K. The developed toner images are intermediately transferred in a sequential order to the intermediate transfer belt 30. The recording medium P loaded in a feeding member 80 is delivered to a nip between the transfer roller 60 and the intermediate transfer belt 30. The toner images that are intermediately transferred onto the intermediate transfer belt 30 are transferred to the recording medium P due to a transfer bias applied to the transfer roller 60. When the recording medium P passes through the fixer 70, the toner images are fixed onto the recording medium P due to heat and a pressure. The recording medium P for which fixing is completed is discharged by a discharging roller 90.

Figure 2:
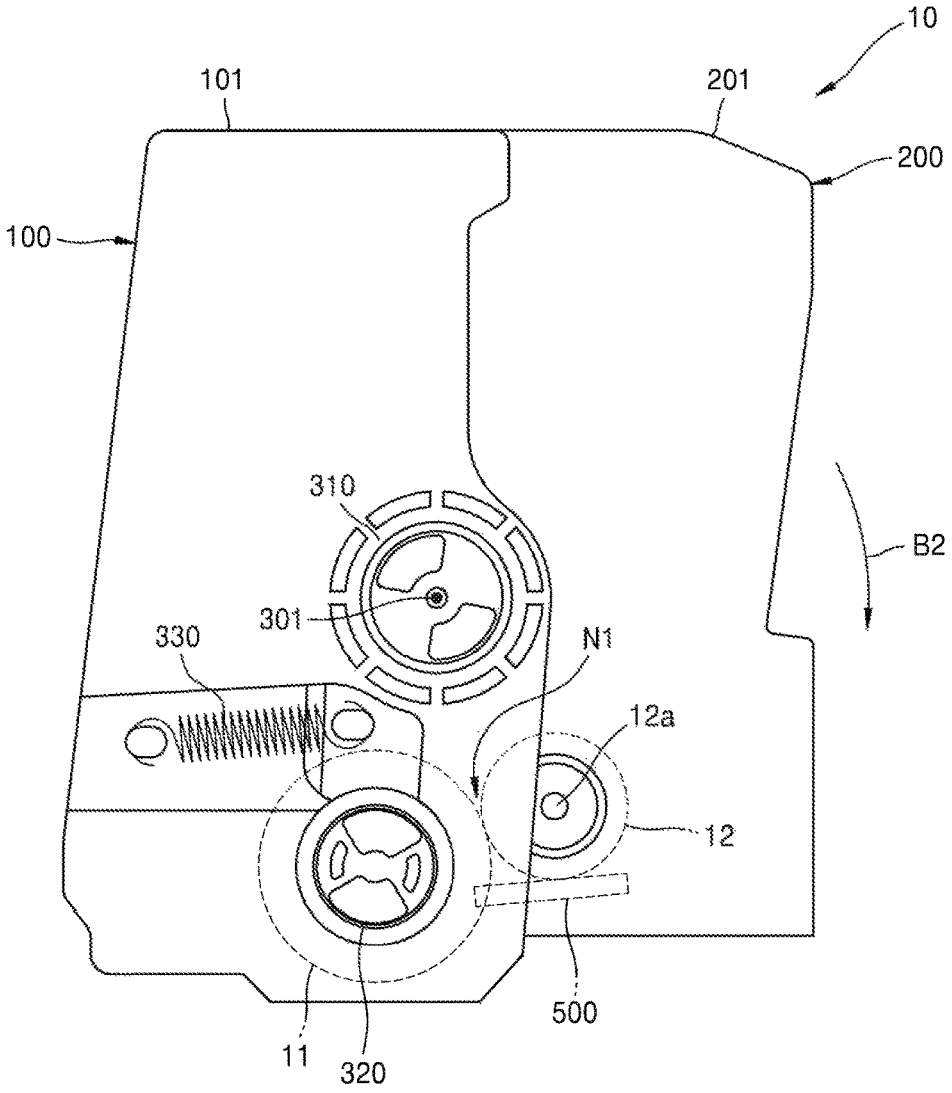
FIG. 2 illustrates a side view of a development cartridge shown in FIG. 1, illustrating a state of the development cartridge in which a photosensitive drum and a developing roller are located at a development position.
Figure 3:
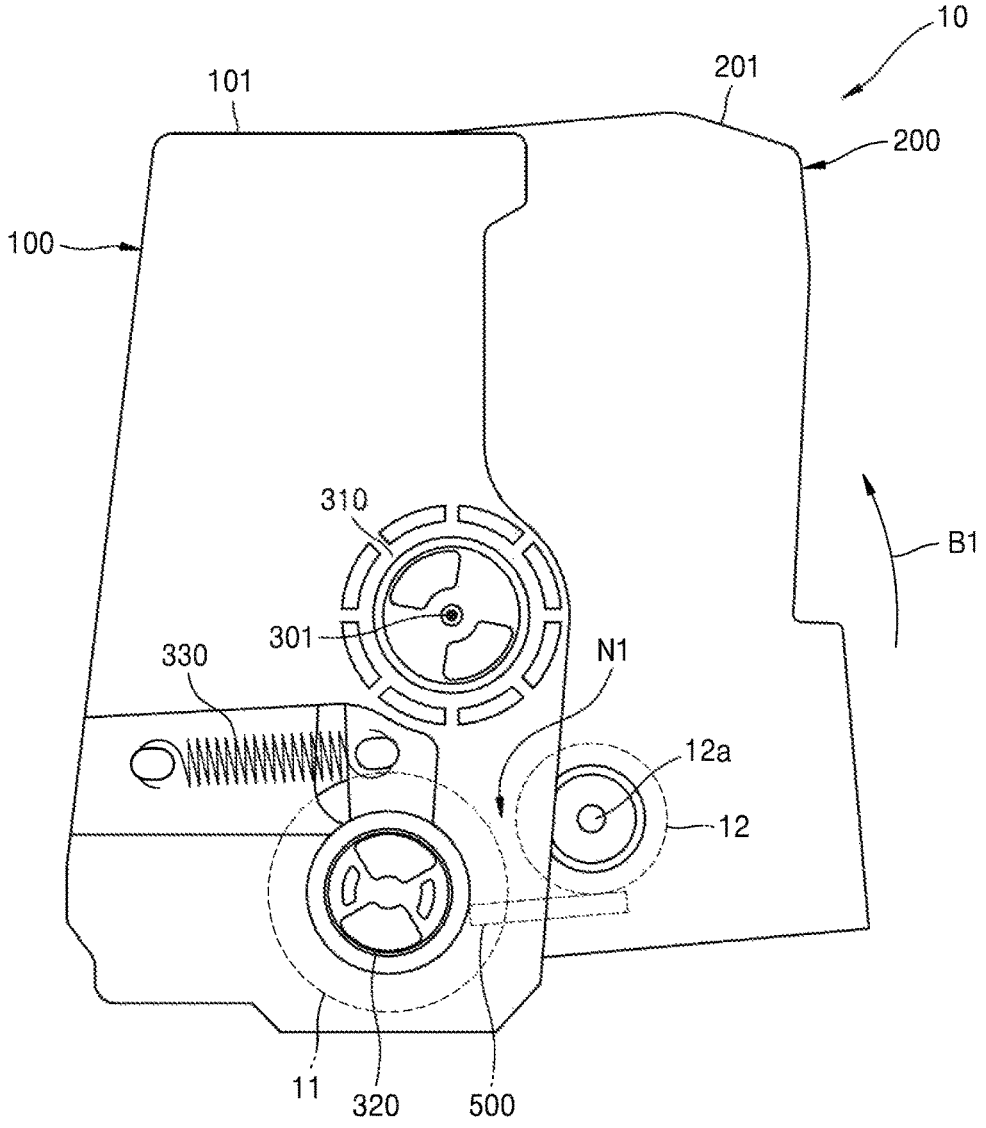
FIG. 3 illustrates a side view of the development cartridge shown in FIG. 1, illustrating a state of the development cartridge in which the photosensitive drum and the developing roller are located at a non-development position.

FIGS. 2 and 3 illustrate side views of the development cartridge 10, according to an embodiment. FIG. 2 illustrates a state of the development cartridge 10 in which the photosensitive drum 11 and the developing roller 12 are located at a development position, and FIG. 3 illustrates a state of the development cartridge 10 in which the photosensitive drum 11 and the developing roller 12 are located at a non-development position.

Referring to FIGS. 2 and 3, the development cartridge 10 may include a photosensitive unit 100 and a developing unit 200. The photosensitive unit 100 may include a first frame 101 and the photosensitive drum 11 supported by the first frame 101. The developing unit 200 may include a second frame 201 and the developing roller 12 supported by the second frame 201. The photosensitive unit 100 and the developing unit 200 are connected to each other so as to rotate to the development position (refer to FIG. 2) where the photosensitive drum 11 and the developing roller 12 contact each other to form a development nip N1 and the non-development position (refer to FIG. 3) where the photosensitive drum 11 and the developing roller 12 are spaced apart from each other to release the development nip N1. For example, the photosensitive unit 100 and the developing unit 200 are connected to rotate around a hinge axis 301. In the image forming apparatus, the photosensitive drum 11 is related to a location of the intermediate transfer roller 50, or the like, thus, when the development cartridge 10 is mounted to the main body 1, a location of the photosensitive drum 11 is fixed. The developing unit 200 is coupled to the photosensitive unit 100 so as to be rotatable with respect to the hinge axis 301. However, the disclosure is not limited thereto, and thus the developing unit 200 may be located at a fixed position in the main body 1, and the photosensitive unit 100 may be coupled to the developing unit 200 so as to be rotatable with respect to the hinge axis 301.

An elastic member 330 provides an elastic force to the developing unit 200 to rotate in a direction where the development nip N1 is to be formed. Due to the elastic force of the elastic member 330, the developing unit 200 rotates with respect to the hinge axis 301, so that the developing roller 12 contacts the photosensitive drum 11 and thus the development nip N1 is formed as shown in FIG. 2. FIGS. 2 and 3 illustrate, as an example of the elastic member 330, a tension coil spring of which ends are supported by the developing unit 200 and the photosensitive unit 100, respectively, but the example of the elastic member 330 is not limited thereto. For example, a member having one of various types including a torsion coil spring, a plate spring, or the like may be used as the elastic member 330.

Rotational members of the development cartridge 10, e.g., the photosensitive drum 11, the charging roller 16, the developing roller 12, the supply roller 13, the development stirring member 15, or the like, may be driven by being connected to a driving motor (not shown) arranged at the main body 1 when the development cartridge 10 is mounted in the main body 1. For example, the development cartridge 10 may have a coupler 310 to be connected to the driving motor (not shown) arranged at the main body 1 when the development cartridge 10 is mounted in the main body 1. The rotational members may be connected to the coupler 310 by a power connecting unit (not shown), e.g., gears. The development cartridge 10 may further have a coupler 320 to be connected to the driving motor (not shown) arranged at the main body 1 when the development cartridge 10 is mounted in the main body 1. In this case, the rotational members (second rotational members) of the developing unit 200, e.g., the developing roller 12, the supply roller 13, the development stirring member 15, or the like, may be driven by being connected to the coupler 310, and the rotational members (first rotational members) of the photosensitive unit 100, e.g., the photosensitive drum 11, the charging roller 16, or the like, may be driven by being connected to the coupler 320. For example, the coupler 320 may be positioned on a same axis as a rotation axis of the photosensitive drum 11 or may be positioned on the rotation axis of the photosensitive drum 11. Although not illustrated, the coupler 310 may be skipped (omitted), and the coupler 320 may be connected with the developing roller 12, the supply roller 13, and the development stirring member 15.

Figure 4:
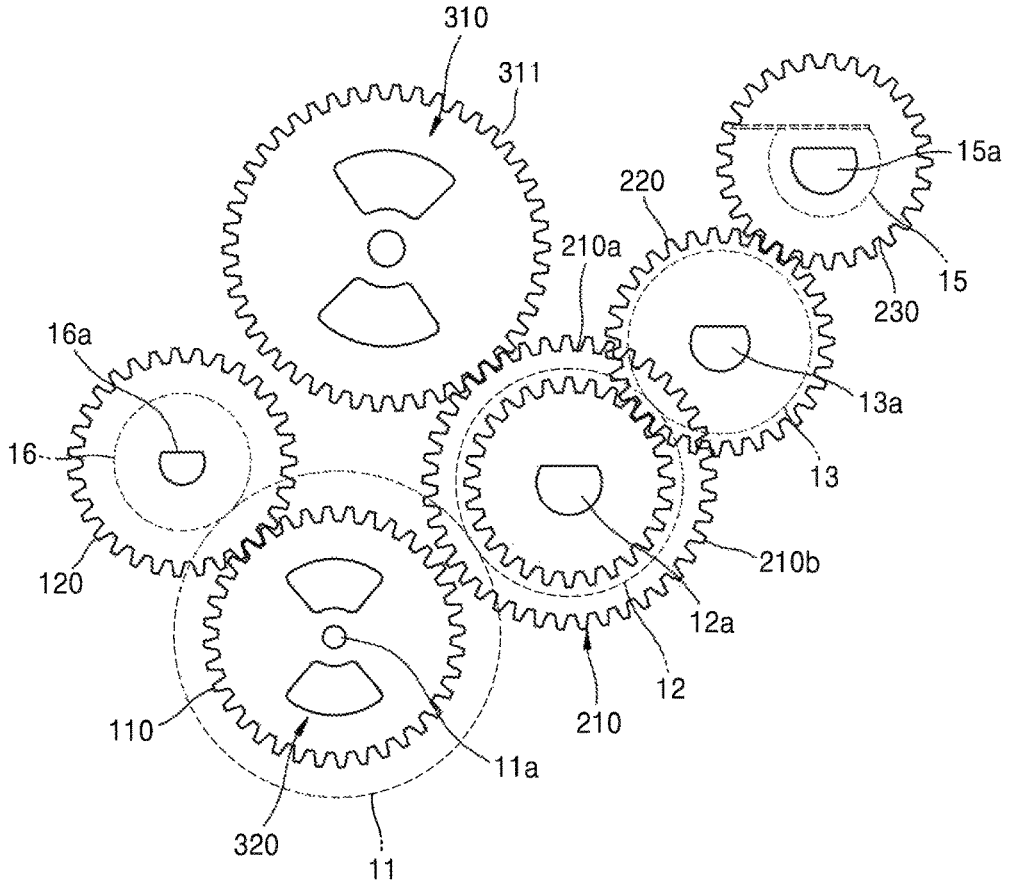
FIG. 4 illustrates an example of a driving connection structure of rotational members of a developing unit and a photosensitive unit.

In the embodiment, the rotational members of the developing unit 200 are driven by the coupler 310, and the rotational members of the photosensitive unit 100 are driven by the coupler 320. FIG. 4 illustrates an example of a driving connection structure of the rotational members of the developing unit 200 and the photosensitive unit 100. Referring to FIG. 4, the coupler 310 may include a gear 311. Gears 210, 220, and 230 are respectively connected to rotation axes 12*a*, 13*a*, and 15*a* of the developing roller 12, the supply roller 13, and the development stirring member 15. The gear 210 is a double stage gear including a gear unit 210*a* and a gear unit 210*b*. The gear unit 210*a* meshes with the gear 311, and the gear unit 210*b* meshes with the gear 220. Torque that is delivered from the main body 1 to the coupler 310 may be delivered to the developing roller 12, the supply roller 13, and the development stirring member 15 through a gear train of the gear 311-the gear 210-the gear 220-the gear 230. The coupler 320 is coupled to a rotation axis 11*a* of the photosensitive drum 11. A gear 110 and a gear 120 are respectively coupled to the rotation axis 11*a* of the photosensitive drum 11 and a rotation axis 16*a* of the charging roller 16. The gear 110 and the gear 120 mesh with each other. By doing so, torque that is delivered from the main body 1 to the coupler 320 may be delivered to the photosensitive drum 11 and the charging roller 16.

The hinge axis 301 may be coaxial with the rotation axis of the coupler 310, but a location of the hinge axis 301 is not limited thereto. The hinge axis 301 may be arranged at a location appropriate for the photosensitive unit 100 and the developing unit 200 to form or not form the development nip N1.

In order to perform a printing operation, the developing roller 12 and the photosensitive drum 11 contact each other and thus are located at a development position for forming the development nip N1, and when the developing roller 12 and the photosensitive drum 11 do not perform the printing operation, the developing roller 12 and the photosensitive drum 11 are spaced apart from each other and thus are located at a non-development position where the development nip N1 is released. In order to form or release the development nip N1, referring to FIGS. 2 and 3, the development cartridge 10 may include a first moving member 500.

In the embodiment, according to a rotation direction of a driving gear to rotate at least one of rotational members of the development cartridge 10, the first moving member 500 is shifted to a first location (refer to FIG. 2) where the developing roller 12 and the photosensitive drum 11 are located at the development position, and is shifted to a second location (refer to FIG. 3) where the developing roller 12 and the photosensitive drum 11 are located at the non-development position. For example, when the driving gear rotates in a first direction A1 for a printing operation, the first moving member 500 is shifted from the second location to the first location, and when the driving gear rotates in a second direction A2 that is opposite to the first direction A1, the first moving member 500 is shifted from the first location to the second location.

Hereinafter, with respect to rotation directions of gears, rotational members, and all rotational elements, a rotation direction during a printing operation is marked as the first direction A1, and a rotation direction during a non-printing operation is marked as the second direction A2.

When the first moving member 500 is shifted from the first location to the second location, the developing unit 200 rotates with respect to the hinge axis 301 in a direction opposite to the elastic force of the elastic member 330, so that the developing roller 12 and the photosensitive drum 11 are shifted from the development position to the non-development position. When the first moving member 500 is shifted from the second location to the first location, the developing unit 200 rotates with respect to the hinge axis 301 due to the elastic force of the elastic member 330, so that the developing roller 12 and the photosensitive drum 11 are shifted from the non-development position to the development position. When the first moving member 500 is shifted from the second location to the first location, the first moving member 500 allows the developing unit 200 to rotate in a direction to the development position.

Hereinafter, embodiments of a structure for shifting the first moving member 500 between the first location and the second location will now be described.

Figure 5:
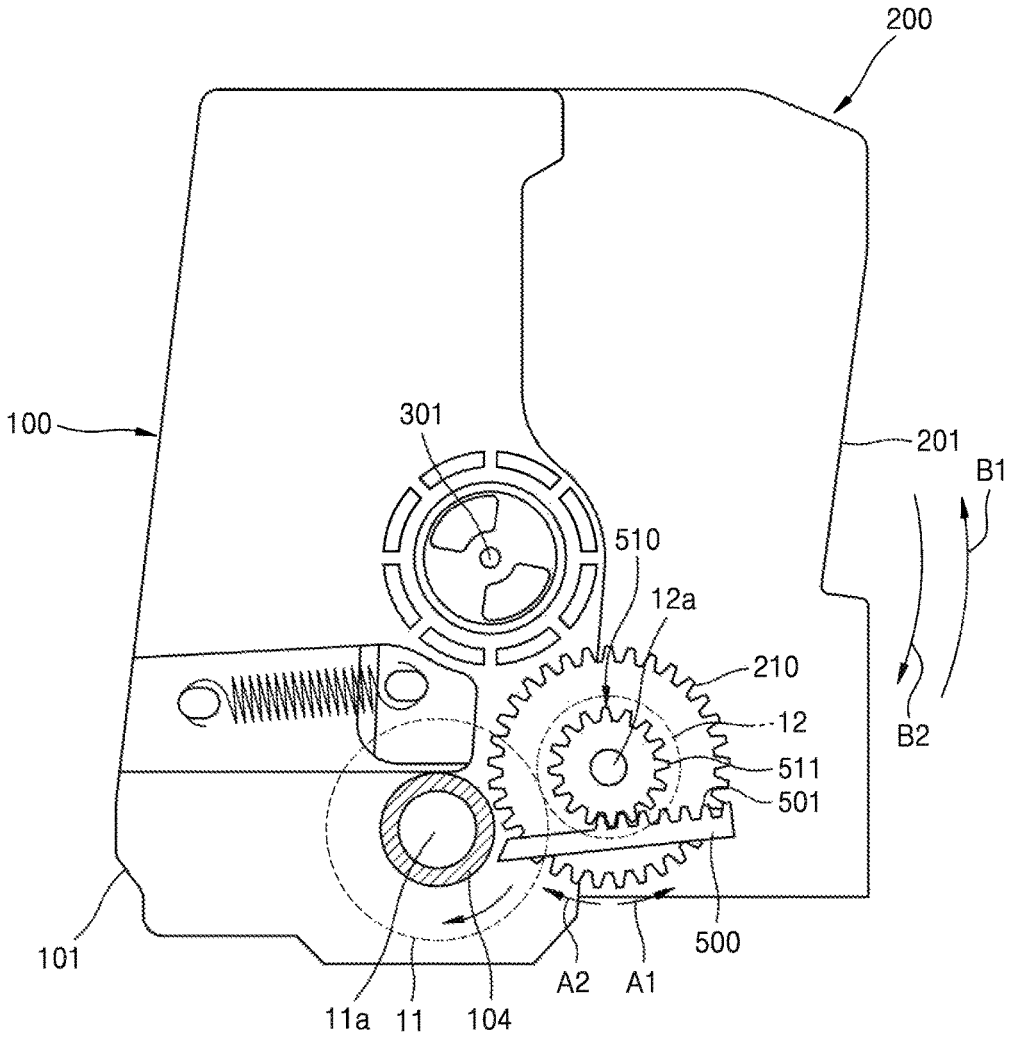
FIG. 5 is a schematic configuration diagram illustrating a structure in which a first moving member is shifted to a first location or a second location, according to an embodiment.

FIG. 5 is a schematic configuration diagram illustrating a structure in which the first moving member 500 is shifted to the first location or the second location, according to an embodiment. In the embodiment, the first moving member 500 may slide to the first location or the second location according to a rotation direction of the driving gear 210 that drives the developing roller 12. Referring to FIG. 5, the first moving member 500 is mounted on the second frame 201 so as to slide in a reciprocating direction. The driving gear 210 is arranged on the rotation axis 12*a* of the developing roller 12. The driving gear 210 is coupled to the rotation axis 12*a* of the developing roller 12 so as to rotate together with the developing roller 12. A driving member 510 is coupled to the rotation axis 12*a* of the developing roller 12 so as to shift the first moving member 500 to the first location or the second location. The driving member 510 is coaxially arranged with respect to the driving gear 210 and thus is rotated by the driving gear 210. Rack gear parts 501 are arranged at the first moving member 500, and pinion gear parts 511 to be engaged with the rack gear parts 501 are arranged at the driving member 510. Therefore, when the driving member 510 rotates, the first moving member 500 is linearly shifted.

The driving member 510 is selectively connected with the driving gear 210 according to a rotation direction of the driving gear 210. For example, when the driving gear 210 rotates in the first direction A1, the driving member 510 is disconnected from the driving gear 210 and thus does not rotate. When the driving gear 210 rotates in the second direction A2, the driving member 510 is connected with the driving gear 210 and thus rotates.

Figure 6:
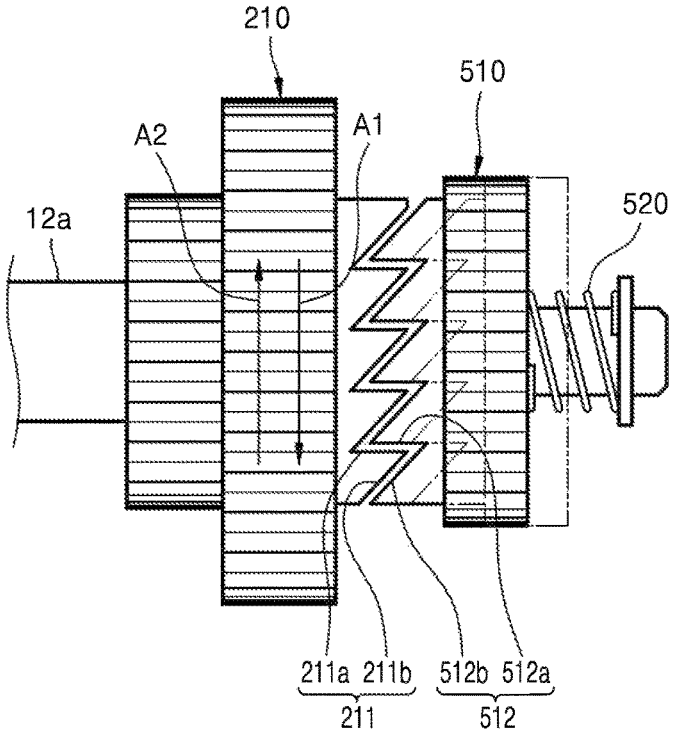
FIG. 6 is a diagram illustrating a one-way clutch that selectively connects a driving member with the driving gear, according to an embodiment.

FIG. 6 is a diagram illustrating a one-way clutch (a first one-way clutch) that selectively connects the driving member 510 with the driving gear 210, according to an embodiment. Referring to FIG. 6, the one-way clutch may include a first clutch unit 211 and a second clutch unit 512, wherein the first clutch unit 211 is arranged at the driving gear 210 and the second clutch unit 512 is arranged at the driving member 510. The first clutch unit 211 has a structure in which a first stumbling portion 211*a* and a first slope portion 211*b* are alternately arrayed in a circumferential direction. The second clutch unit 512 has a structure in which a second stumbling portion 512*a* and a second slope portion 512*b* are alternately arrayed in the circumferential direction, wherein the second stumbling portion 512*a* and the second slope portion 512*b* face the first stumbling portion 211*a* and the first slope portion 211*b*, respectively. An elastic member 520 pushes the driving member 510 toward the driving gear 210.

According to the aforementioned configuration, when the driving gear 210 rotates in the first direction A1, the first and second slope portions 211*b* and 512*b* contact each other, so that the driving member 510 is pushed in an opposite direction of an elastic force of the elastic member 520 as shown using a broken line in FIG. 6. Therefore, the first and second stumbling portions 211*a* and 512*a* are spaced apart from each other, and thus, even though the driving gear 210 rotates, the driving member 510 does not rotate. When the driving gear 210 rotates in the second direction A2, the driving member 510 is pushed toward the driving gear 210 due to the elastic force of the elastic member 520, and when the first and second stumbling portions 211*a* and 512*a* face each other and the driving gear 210 rotates in the second direction A2, the driving member 510 also rotates in the second direction A2.

Referring to FIGS. 2 and 5, the first moving member 500 is located at the first location. The photosensitive drum 11 and the developing roller 12 are located at the development position while contacting each other due to the elastic force of the elastic member 330. In this state, when the driving gear 210 rotates in the first direction A1, as shown using the broken line in FIG. 6, the first and second clutch units 211 and 512 are spaced apart from each other so that the driving gear 210 is disconnected from the driving member 510, thus, the driving member 510 does not rotate. Therefore, while a printing operation is performed, the photosensitive drum 11 and the developing roller 12 remain at the development position.

When the printing operation is ended, for example, the driving motor arranged at the main body 1 rotates the driving gear 210 in the second direction A2. Then, as shown using a solid line in FIG. 6, the first and second clutch units 211 and 512 are connected with each other, the driving member 510 rotates in the second direction A2. Due to the pinion gear parts 511 and the rack gear parts 501, the first moving member 500 moves forward toward the photosensitive drum 11. The first moving member 500 pushes the photosensitive unit 100. For example, the first moving member 500 may contact a contact portion 104 of the first frame 101 supporting the photosensitive drum 11 and may push the photosensitive unit 100. When the photosensitive drum 11 is mounted in the main body 1, the photosensitive drum 11 is fixed in the main body 1, thus, the photosensitive unit 100 is also fixed in the main body 1. Therefore, the developing unit 200 rotates with respect to the hinge axis 301 in an opposite direction of the elastic force of the elastic member 330, i.e., the developing unit 200 rotates in a direction B1 of FIG. 5. As shown in FIG. 3, when the first moving member 500 arrives at the second location, the developing roller 12 arrives at the non-development position spaced apart from the photosensitive drum 11. Since the rack gear parts 501, the pinion gear parts 511, the first clutch unit 211, and the second clutch unit 512 are engaged with each other, and the driving gear 210 is connected with the driving motor of the main body 1, in spite of the elastic force of the elastic member 330, when the driving gear 210 is stopped, the photosensitive drum 11 and the developing roller 12 remain at the non-development position.

When the driving gear 210 rotates in the first direction A1 so as to perform a printing operation in a state shown in FIG. 3, as shown using the broken line in FIG. 6, the second clutch unit 512 is spaced apart from the first clutch unit 211 so that the driving gear 210 is disconnected from the driving member 510, and the driving member 510 may freely rotate. Due to the elastic force of the elastic member 330, the second frame 201 rotates with respect to the hinge axis 301 in a direction where the developing roller 12 approaches the photosensitive drum 11, i.e., a direction B2 of FIG. 5. When the second frame 201 rotates in the direction B2, the first moving member 500 is shifted from the first location to the second location, and the driving member 510 naturally rotates in the first direction A1 so that the driving member 510 allows the first moving member 500 to be shifted from the first location to the second location. The developing roller 12 and the photosensitive drum 11 arrive at the development position where the developing roller 12 and the photosensitive drum 11 contact each other, and the first moving member 500 arrives at the second location.

According to the aforementioned configuration, a driving structure for driving the first moving member 500 is arranged in the development cartridge 10, and it is not required to arrange a separate device in the main body 1. Therefore, it is possible to drive the first moving member 500 by using the driving motor that drives the rotational members of the development cartridge 10 by using the simple driving structure.

In a case in which an integrated first moving member (not shown) for integrally controlling the development nips N1 of the development cartridges 10C, 10M, 10Y, and 10K is arranged at the main body 1, elastic forces of the elastic member 330 of the development cartridges 10C, 10M, 10Y, and 10K are simultaneously applied to the integrated first moving member, thus, a motor having a large driving force is required to drive the integrated first moving member and durability of each of the integrated first moving member and a driving member for driving the integrated first moving member may deteriorate. According to the embodiment, since the first moving member 500 is arranged at each of the development cartridges 10C, 10M, 10Y, and 10K, the development nips N1 of the development cartridges 10C, 10M, 10Y, and 10K may be individually controlled. Therefore, it is possible to drive the first moving member 500 by using a small driving force, and durability of a driving member for controlling the development nips N1 may be relatively improved. In addition, in order to print a single-colored image, the photosensitive drum 11 and the developing roller 12 of each of the development cartridges 10C, 10M, and 10Y are located at the non-development position, and the photosensitive drum 11 and the developing roller 12 of the development cartridge 10K may be located at the development position.

In addition, the first moving member 500 is driven by the small driving force, and a speed of the driving motor while the driving motor drives the first moving member 500 may be adjusted. Therefore, a shift speed for shifting the photosensitive drum 11 and the developing roller 12 from the development position to the non-development position may be adjusted by adjusting the speed of the driving motor, so that noise due to a position change may be decreased.

A distance between the photosensitive drum 11 and the developing roller 12 at the non-development position may be controlled by controlling an amount of rotation of the driving gear 210 in the second direction A2. In other words, the amount of rotation of the driving gear 210 in the second direction A2 may be controlled by controlling an amount of rotation of the driving motor (not shown) arranged at the main body 1. A size of the development nip N1, i.e., an amount of overlap between the developing roller 12 and the photosensitive drum 11 at the development position may be quite different from a designed value, according to a manufacture error of the elements that configure the development cartridge 10. Even if a desired separation distance cannot be achieved at the non-development position due to the manufacture error, the desired separation distance may be achieved by adjusting the amount of rotation of the driving motor, without modifying shapes of elements for controlling a development nip, for example, shapes of the first moving member 500, the second frame 201 at which the first moving member 500 is mounted, or the like. Therefore, according to the embodiment, an error of the separation distance due to the manufacture error may be compensated for by software-based modification that involves adjusting the amount of rotation of the driving motor.

The separation distance between the photosensitive drum 11 and the developing roller 12 is controlled by the first moving member 500 only at the non-development position. At the development position, the first moving member 500 does not greatly affect the size of the development nip N1. Therefore, the development nip N1 may be stably maintained resulting in stability of an image quality.

Figure 7:
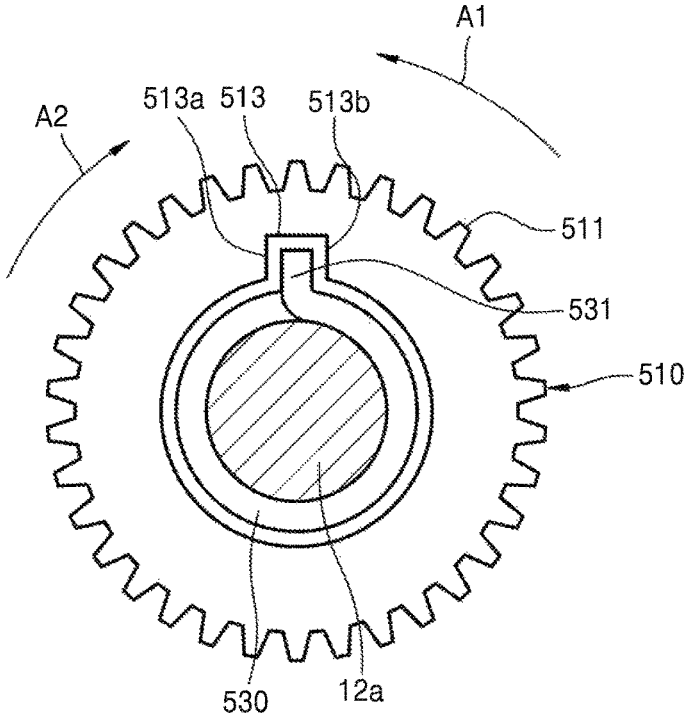
FIG. 7 is a diagram illustrating a one-way clutch, according to an embodiment.

The one-way clutch is not limited to the example of FIG. 6. FIG. 7 is a diagram illustrating a one-way clutch (a first one-way clutch), according to an embodiment. FIG. 7 illustrates the one-direction clutch with a spring clutch structure. Referring to FIG. 7, the driving member 510 is rotatably arranged on the rotation axis 12*a* of the developing roller 12. A clutch spring 530 is wound up around the rotation axis 12*a* of the developing roller 12. An end 531 of the clutch spring 530 projects in a radial direction and is held in a spring groove 513 of the driving member 510. When the driving gear 210 not shown in the embodiment is coupled to the rotation axis 12*a* of the developing roller 12 and then rotates, the developing roller 12 rotates.

When the developing roller 12 rotates in the first direction A1, the end 531 of the clutch spring 530 pushes an end 513*a* of the groove 513. Here, a reaction force in the second direction A2 is applied to the end 531, due to that, the clutch spring 530 is slightly loosened from the rotation axis 12*a*. Then, the rotation axis 12*a* slips with respect to the clutch spring 530, and torque of the rotation axis 12*a* is not delivered to the clutch spring 530. Therefore, the driving member 510 does not rotate.

When the developing roller 12 rotates in the second direction A2, the end 531 of the clutch spring 530 pushes an end 513*b* of the groove 513. Here, a reaction force in the first direction A1 is applied to the end 531, due to that, the clutch spring 530 tightens the rotation axis 12*a*. By doing so, the clutch spring 530 rotates together with the rotation axis 12*a*, and since the end 531 pushes the driving member 510, the driving member 510 also rotates in the second direction A2.

According to the aforementioned configuration, it is possible to selectively rotate the driving member 510 according to a rotation direction of the driving gear 210.

The developing roller 12 may rotate only when the driving gear 210 rotates in the first direction A1, and may not rotate when the driving gear 210 rotates in the second direction A2. To do so, the one-way clutch may also be arranged between the driving gear 210 and the developing roller 12.

Figure 8:
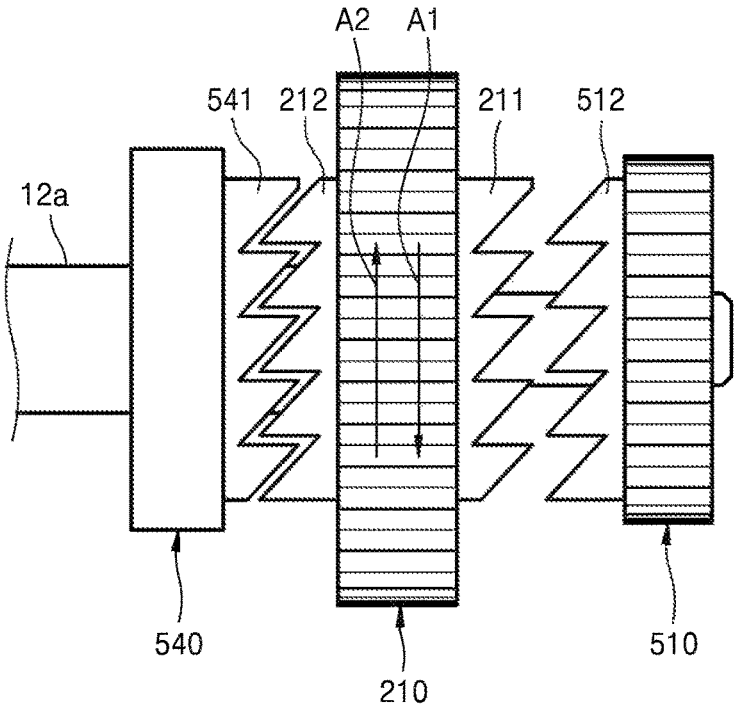
FIGS. 8 and 9 are diagrams illustrating a one-way clutch for driving the developing roller in one direction, according to embodiments.
Figure 9:
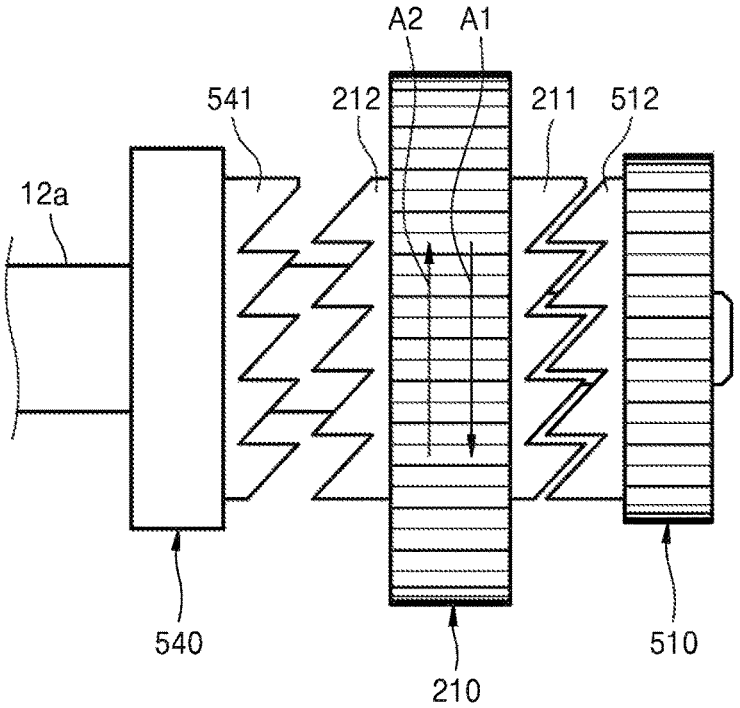

FIGS. 8 and 9 are diagrams illustrating a one-way clutch for driving the developing roller 12 in one direction, according to one or more embodiments. Referring to FIGS. 8 and 9, a driving bush 540 is coupled to the rotation axis 12*a* of the developing roller 12. The driving gear 210 and the driving member 510 are rotatably coupled to the rotation axis 12*a*. A first one-way clutch is arranged between the driving gear 210 and the driving member 510, and a second one-way clutch is arranged between the driving gear 210 and the driving bush 540.

A structure of the first one-way clutch is equal to a structure of the one-way clutch shown in FIG. 6. That is, the driving gear 210 and the driving member 510 are selectively connected by the first and second clutch units 211 and 512 according to a rotation direction of the driving gear 210. That is, when the driving gear 210 rotates in the first direction A1, the first one-way clutch disconnects power between the driving gear 210 and the driving member 510, and when the driving gear 210 rotates in the second direction A2, the first one-way clutch connects the power between the driving gear 210 and the driving member 510.

The second one-way clutch may be embodied by a third clutch unit 212 and a fourth clutch unit 541, wherein the third clutch unit 212 is arranged at the driving gear 210 and the fourth clutch unit 541 is arranged at the driving bush 540. Structures of the third and fourth clutch units 212 and 541 are the same as structures of the first and second clutch units 211 and 512. However, the third and fourth clutch units 212 and 541 are connected to each other when the driving gear 210 rotates in the first direction A1, so that the driving gear 210 and the driving bush 540 rotate together, and when the driving gear 210 rotates in the second direction A2, the third and fourth clutch units 212 and 541 are spaced apart from each other, so that the driving bush 540 does not rotate.

When the driving gear 210 rotates in the first direction A1 for a printing operation, as shown in FIG. 8, the third and fourth clutch units 212 and 541 are engaged with each other so that the driving bush 540 and the driving gear 210 rotate together in the first direction A1. Therefore, the developing roller 12 rotates in the first direction A1. In this regard, since the first clutch unit 211 and the second clutch unit 512 are spaced apart from each other, the driving member 510 does not rotate.

After the printing operation is ended, when the driving gear 210 rotates in the second direction A2, the third clutch unit 212 moves away from the fourth clutch unit 541, and the driving gear 210 is spaced apart from the driving bush 540 and is moved toward the driving member 510 along the rotation axis 12*a*. The connection between the third and fourth clutch units 212 and 541 is disconnected, the first and second clutch units 211 and 512 are connected with each other. Thus, when the driving gear 210 rotates in the second direction A2, the driving bush 540 and the developing roller 12 do not rotate, and the driving member 510 rotates in the second direction A2, so that the first moving member 500 may be shifted from the first location to the second location.

When the driving gear 210 rotates in the first direction A1 in a state shown in FIG. 9, the first clutch unit 211 is spaced apart from the second clutch unit 512, and the driving gear 210 is spaced apart from the driving member 510 and approaches toward the driving bush 540. The third clutch unit 212 and the fourth clutch unit 541 are connected with each other, and the connection between the first and second clutch units 211 and 512 is disconnected. Therefore, when the driving gear 210 keeps rotating in the first direction A1, the driving bush 540 and the developing roller 12 rotate in the first direction A1. The developing unit 200 rotates with respect to the hinge axis 301 so as to locate the photosensitive drum 11 and the developing roller 12 at the development position by using the elastic force of the elastic member 330. Since the developing unit 200 rotates, the first moving member 500 is shifted from the second location to the first location, and the driving member 510 slightly rotates in the first direction A1.

A speed reducer may be arranged between the driving gear 210 and the driving member 510. By doing so, it is possible to stably control the development nip N1 without increasing torque of the driving motor. In addition, it is possible to precisely control a position of the first moving member 500.

Figure 10:
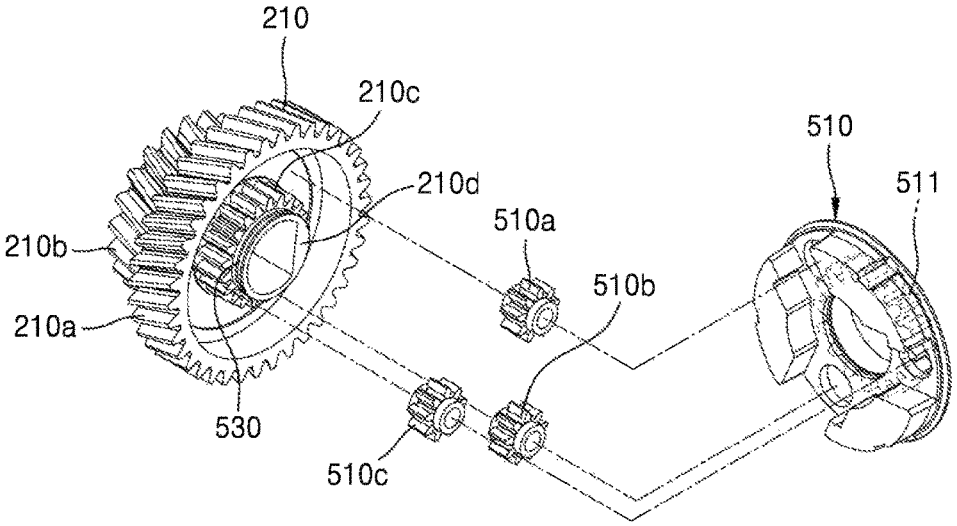
FIG. 10 is a diagram illustrating a speed reducer between the driving gear and the driving member, according to an embodiment.

FIG. 10 is a diagram illustrating the speed reducer between the driving gear 210 and the driving member 510, according to an embodiment. Referring to FIG. 10, the driving gear 210 may include a sun gear 210*c*. For example, three planet gears 510*a*, 510*b*, and 510*c* are rotatably mounted at the driving member 510. The three planet gears 510*a*, 510*b*, and 510*c* are engaged with the sun gear 210*c*. According to the aforementioned configuration, when the driving gear 210 rotates, the driving member 510 decelerates and rotates in an opposite direction. Therefore, although not illustrated, the rack gear parts 501 of the first moving member 500 are arranged to be engaged with the pinion gear parts 511 above the driving member 510 in FIG. 5.

With this configuration, it is possible to embody the speed reducer that occupies a very compact space.

When the driving gear 210 rotates in the second direction A2, the driving member 510 rotates in the first direction A1, and a first moving member 500 is shifted from the first location to the second location. When the driving gear 210 rotates in the first direction A1, the driving member 510 rotates in the second direction A2, and the first moving member 500 is shifted from the second location to the first location. In this state, connection between the rack gear parts 501 and the pinion gear parts 511 is disconnected, and the first moving member (nip control member) 500 remains at the first location.

The one-way clutch shown in FIG. 7 may be arranged between the driving gear 210 and the sun gear 210*c*. Referring to FIG. 10, a bush 210*d* is arranged at the driving gear 210, and the clutch spring 530 is wound up around the bush 210*d*. The sun gear 210*c* is inserted into the driving gear 210 while the sun gear 210*c* surrounds the clutch spring 530.

A connection relationship between the clutch spring 530 and the bush 210*d* is understandable by treating the driving member 510 of FIG. 7 as the sun gear 210*c* and treating the rotation axis 12*a* as the bush 210*d*. According to the aforementioned configuration, when the driving gear 210 rotates in the first direction A1, the sun gear 210*c* does not rotate, and the driving member 510 does not rotate either. Only when the driving gear 210 rotates in the second direction A2, the sun gear 210*c* may rotate in the second direction A2, and the driving member 510 may rotate in the first direction A1.

Figure 11:
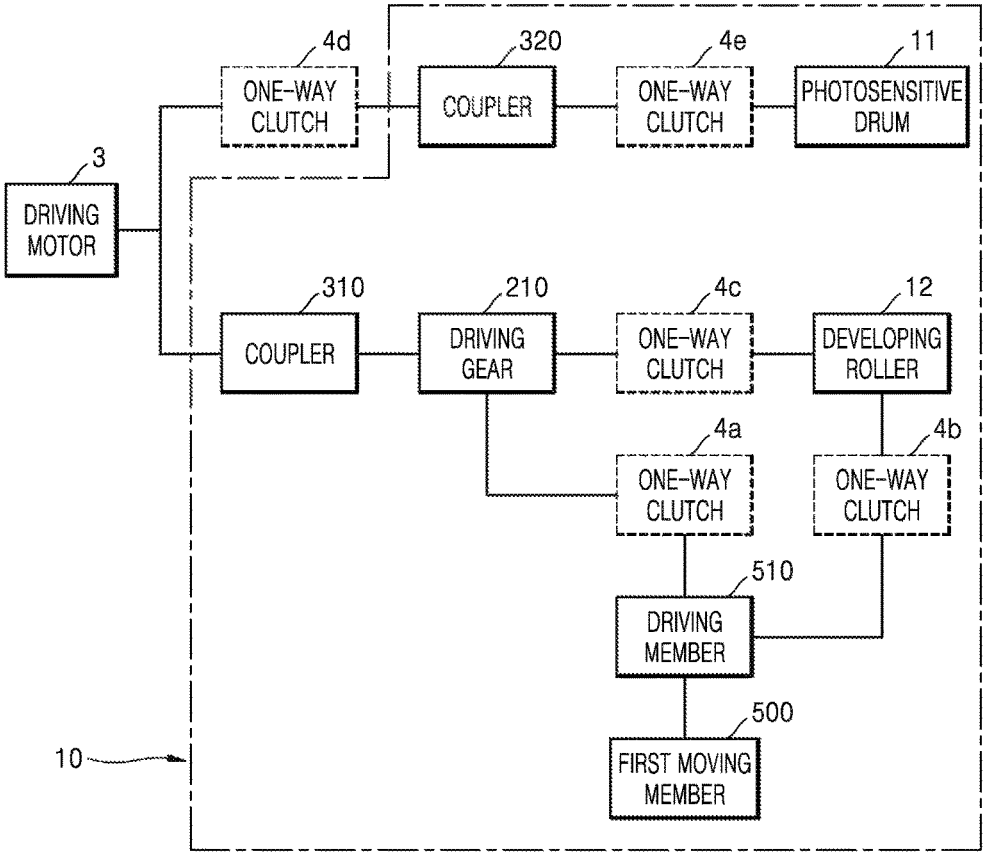
FIG. 11 is a diagram illustrating an example of a driving connection structure of a case in which the developing roller and the photosensitive drum are driven by a same driving motor.

In the aforementioned embodiments, the developing roller 12 and the photosensitive drum 11 may be driven by a same driving motor. FIG. 11 is a diagram illustrating an example of a driving connection structure of a case in which the developing roller 12 and the photosensitive drum 11 are driven by a same driving motor 3. Referring to FIG. 11, the driving motor 3 may drive the developing roller 12 through the coupler 310 and the driving gear 210. In addition, the driving motor 3 may drive the photosensitive drum 11 through the coupler 320. The driving member 510 may be connected with the driving gear 210 by having a one-way clutch 4*a* arranged therebetween, or may be connected with the driving gear 210 through a one-way clutch 4*b* and the developing roller 12. The one-way clutch 4*a* may be the one-way clutch shown in FIG. 6, and the one-way clutch 4*b* may be the one-direction clutch shown in FIG. 7. According to the aforementioned configuration, when the driving gear 210 rotates in the first direction A1 or the second direction A2, the developing roller 12 and the photosensitive drum 11 also rotate.

The developing roller 12 may be connected with the driving gear 210 through a one-way clutch 4*c*. In this case, the driving member 510 is connected with the driving gear 210 through the one-way clutch 4*a*. The one-way clutch 4*a* and the one-way clutch 4*c* may each be the one-way clutch shown in FIG. 8. According to the aforementioned configuration, when the driving gear 210 rotates in the first direction A1 or the second direction A2, the photosensitive drum 11 rotates in both cases but the developing roller 12 rotates only when the driving gear 210 rotates in the first direction A1.

The photosensitive drum 11 may rotate only when the driving gear 210 rotates in the first direction A1, and may not rotate when the driving gear 210 rotates in the second direction A2. In this case, for example, a one-way clutch 4*e* may be arranged between the coupler 320 and the photosensitive drum 11. It is apparent that a one-way clutch 4*d* may be arranged between the driving motor 3 and the coupler 320. The one-way clutches 4*e* and 4*d* may each be the one-way clutch shown in FIG. 6 or 7.

Figure 12:
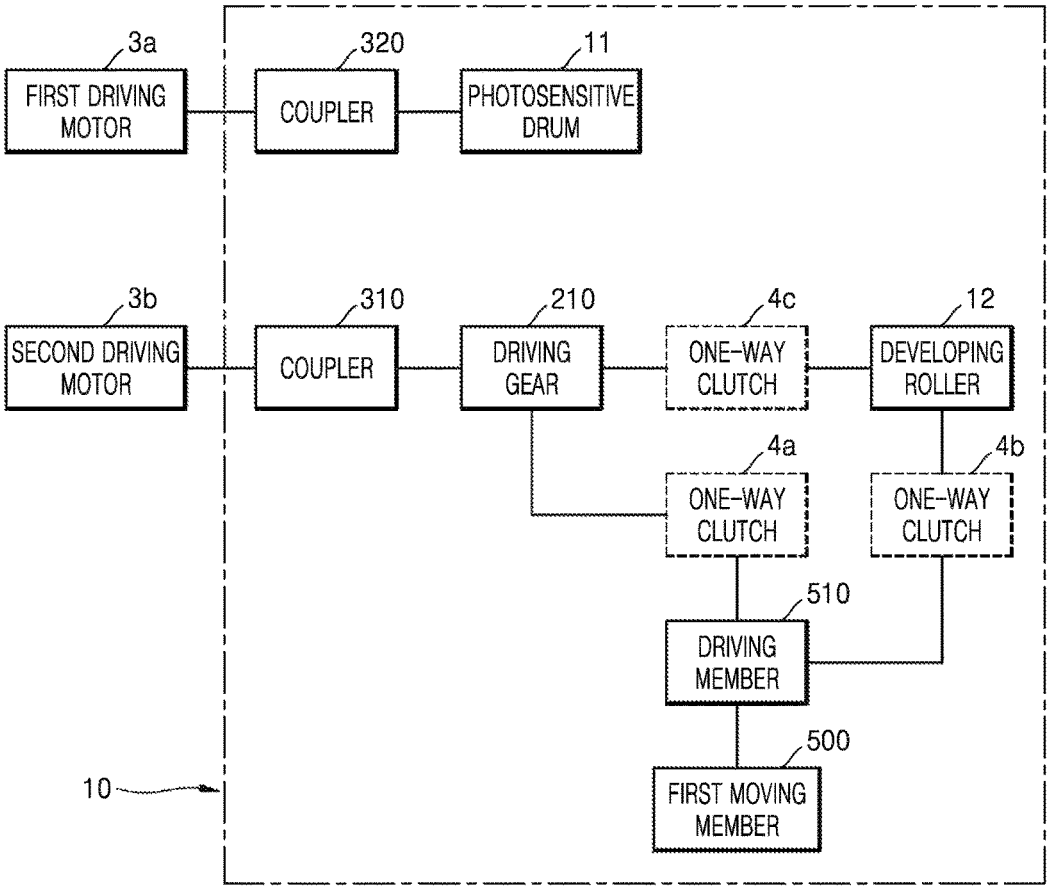
FIG. 12 is a diagram illustrating an example of a driving connection structure of a case in which the developing roller and the photosensitive drum are driven by different driving motors.

FIG. 12 is a diagram illustrating an example of a driving connection structure of a case in which the developing roller 12 and the photosensitive drum 11 are driven by different driving motors. Referring to FIG. 12, a first driving motor 3*a* drives the photosensitive drum 11 through the coupler 320. A second driving motor 3*b* may drive the developing roller 12 through the coupler 310 and the driving gear 210. The driving member 510 may be connected with the driving gear 210 by having the one-way clutch 4*a* arranged therebetween, or may be connected with the driving gear 210 through the one-way clutch 4*b* and the developing roller 12. The one-way clutch 4*a* may be the one-way clutch shown in FIG. 6, and the one-way clutch 4*b* may be the one-way clutch shown in FIG. 7. According to the aforementioned configuration, when the driving gear 210 rotates in the first direction A1 or the second direction A2, the developing roller 12 also rotates. The developing roller 12 may be connected with the driving gear 210 through the one-way clutch 4*c*. In this case, the driving member 510 is connected with the driving gear 210 through the one-way clutch 4*a*. The one-way clutch 4*a* and the one-way clutch 4*c* may each be the one-way clutch shown in FIG. 8. According to the aforementioned configuration, the developing roller 12 rotates only when the driving gear 210 rotates in the first direction A1.

The photosensitive drum 11 may turn on or off the first driving motor 3*a* according to a rotation direction of the driving gear 210, so that the photosensitive drum 11 may rotate when the driving gear 210 rotates in the first direction A1, and may stop when the driving gear 210 rotates in the second direction A2.

In the aforementioned embodiment, it is described that the first moving member 500 is driven by using the driving gear 210 coupled to the rotation axis 12*a* of the developing roller 12, but the scope of the disclosure is not limited thereto. The first moving member 500 may be driven by using another rotational member such as the gear 220 coupled to the rotation axis 13*a* of the supply roller 13, or the gear 230 coupled to the rotation axis 15*a* of the development stirring member 15. In this case, the driving member 510 may be arranged on the rotation axis 13*a* of the supply roller 13 or the rotation axis 15*a* of the development stirring member 15, and in the aforementioned embodiments, the driving gear 210 may be the gear 220 or the gear 230.

In addition, it is not required that a driving gear that selectively drives the driving member 510 is necessarily arranged at the rotational member of the development cartridge 10, for example, one of the rotation axes 12*a*, 13*a*, and 15*a* of the developing roller 12, the supply roller 13, and the development stirring member 15. It is acceptable that the driving gear is one of gears that belong to the gear train for driving the rotational member of the developing unit 200.

Figure 13:
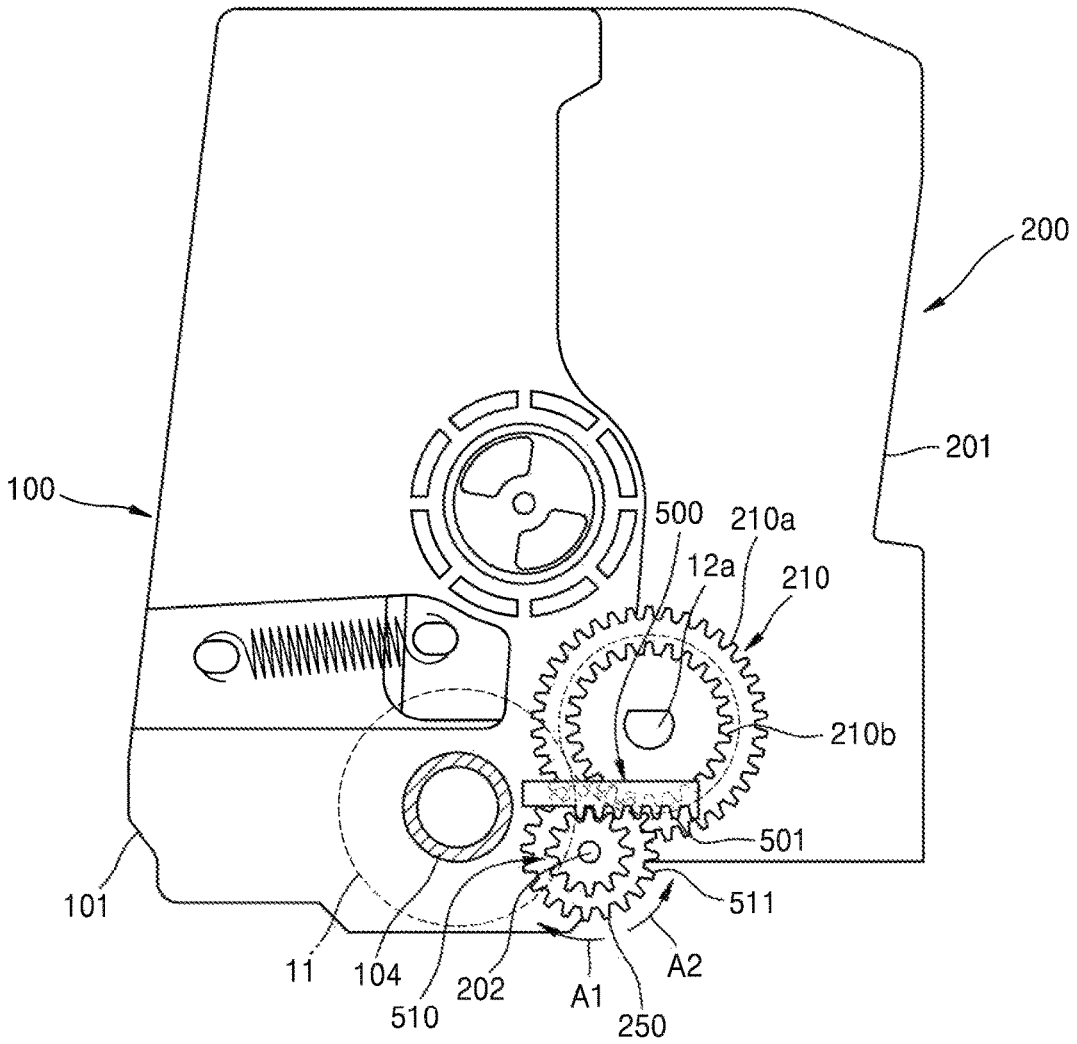
FIG. 13 is a diagram illustrating the development cartridge, according to an embodiment.

FIG. 13 is a diagram illustrating the development cartridge 10, according to an embodiment. Referring to FIG. 13, an axis 202 is mounted at the second frame 201 of the developing unit 200. A driving gear 250 and the driving member 510 are coupled to the axis 202. The driving gear 250 receives torque from the coupler 310. For example, the driving gear 250 is engaged with the gear unit 210*b* of the driving gear 210.

A structure of the driving gear 250 and the driving member 510 is the same as in the aforementioned embodiment. For example, the axis 202 may be fixed at the second frame 201, and the driving gear 250 is mounted to be rotatable with respect to the axis 202. The driving gear 250 and the driving member 510 may have same forms as those of the driving gear 210 and the driving member 510 shown in FIG. 6. In this case, the driving gear 210 of FIG. 6 may be the driving gear 250.

When the axis 202 is coupled to the second frame 201 so as to rotate together with the driving gear 250, the driving member 510 may be selectively power-connected to the axis 202 by the clutch spring 530, as shown in FIG. 7. In this case, in FIG. 7, the rotation axis 12*a* may be the axis 202.

According to the aforementioned configuration, when the driving gear 250 rotates in the first direction A1 for a printing operation, the driving member 510 does not rotate. Therefore, the first moving member 500 is located at the first location, and the photosensitive drum 11 and the developing roller 12 are located at the development position as shown in FIG. 2.

When the driving gear 250 rotates in the second direction A2, the driving member 510 is connected with the driving gear 250 and thus rotates in the second direction A2. Then, the first moving member 500 is shifted from the first location to the second location, and the second frame 201 rotates with respect to the hinge axis 301 in a direction opposite to the elastic force of the elastic member 330, so that the photosensitive drum 11 and the developing roller 12 are located at the non-development position where the photosensitive drum 11 and the developing roller 12 are spaced apart from each other. In this state, when the developing roller 12 rotates in the first direction A1 and thus the driving gear 210 rotates in the second direction A2, connection between the driving gear 250 and the driving member 510 is disconnected, and the driving member 510 may freely rotate. Due to the elastic force of the elastic member 330, the second frame 201 rotates with respect to the hinge axis 301 in a direction where the photosensitive drum 11 and the developing roller 12 contact each other, and the first moving member 500 slightly rotates the driving member 510 in the second direction A2 and is shifted from the second location to the first location.

During the printing operation, the photosensitive drum 11 and the charging roller 16 contact each other and form a charging nip N2. When the charging nip N2 is formed during a non-printing operation, the photosensitive drum 11 and the charging roller 16 may be deformed and damaged. When the first moving member 500 is moved to the second location and thus the photosensitive drum 11 and the developing roller 12 are located at the non-development position, the charging roller 16 may be spaced apart from the photosensitive drum 11, and by doing so, the development nip N1 and the charging nip N2 may be simultaneously controlled.

Figure 14:
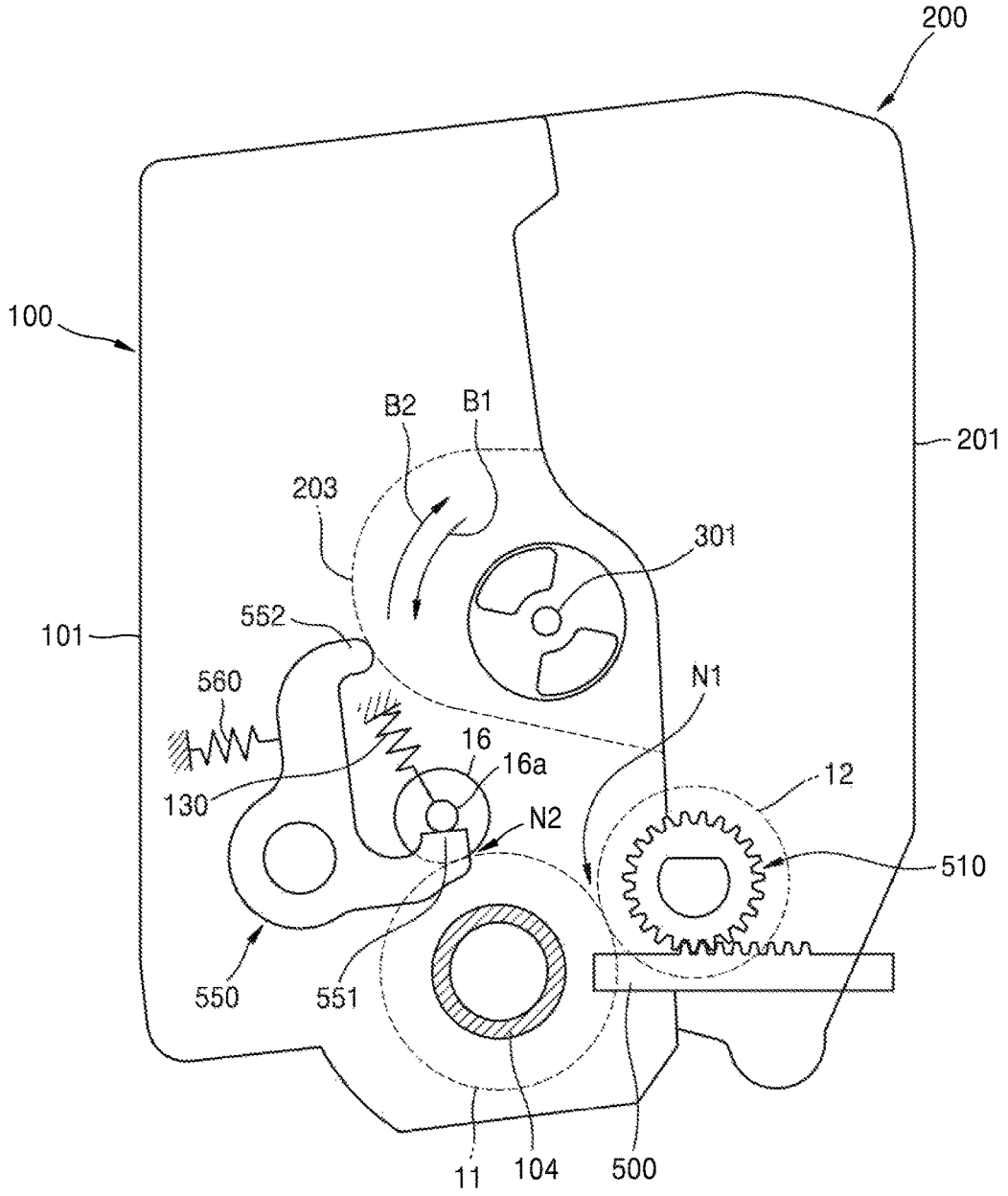
FIGS. 14 and 15 are diagrams illustrating the development cartridge, according to an embodiment.
Figure 15:
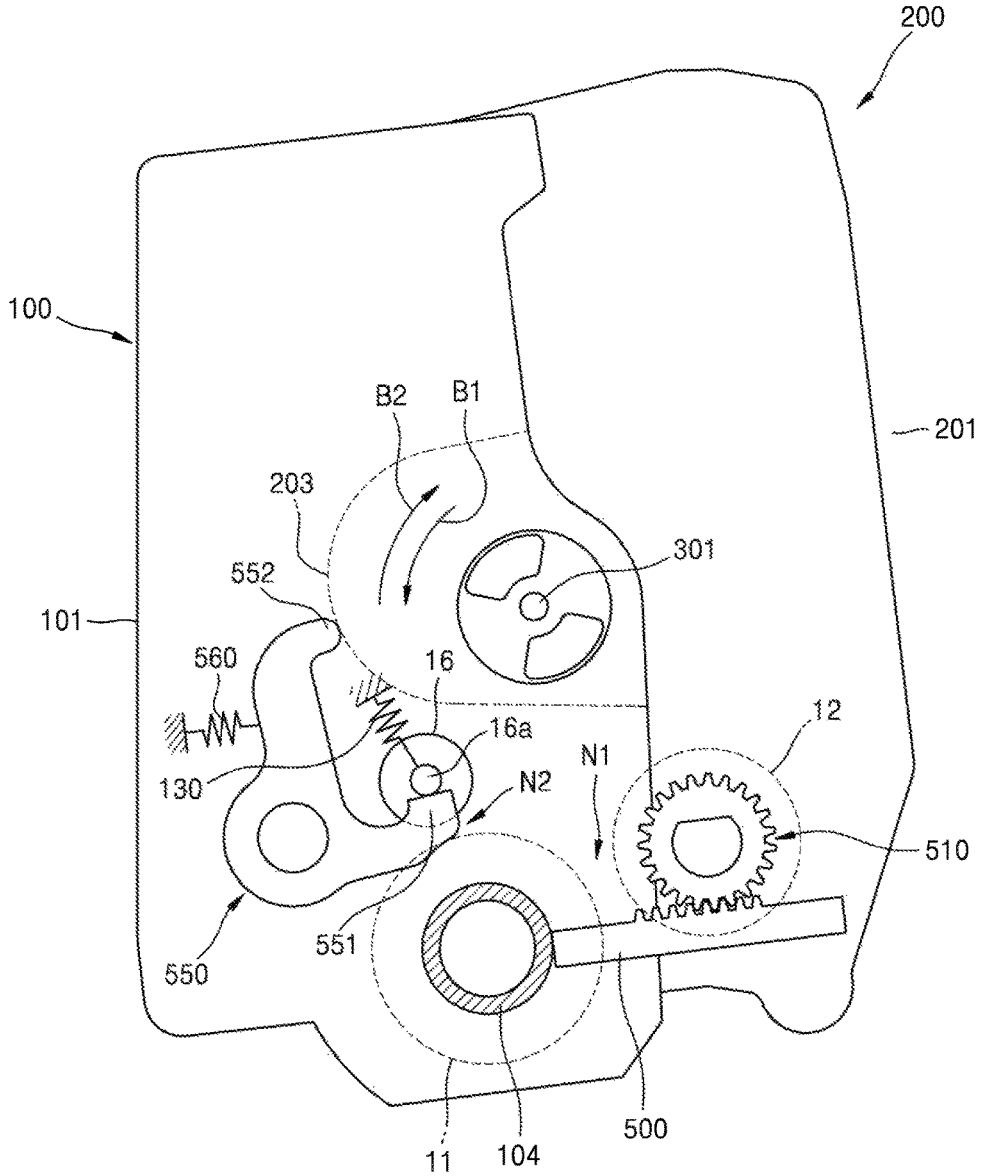

FIGS. 14 and 15 are diagrams illustrating the development cartridge 10, according to an embodiment. Referring to FIGS. 14 and 15, the charging roller 16 is biased in a direction so as to contact the photosensitive drum 11 due to an elastic force of a second elastic member 130. A second moving member 550 including a first lever portion 551 and a second lever portion 552 is arranged at the first frame 101. The first lever portion 551 is located close to the rotation axis 16*a* of the charging roller 16. The second moving member 550 may be shifted between a non-charging position and a charging position, wherein, at the non-charging position, the first lever portion 551 pushes the rotation axis 16*a* of the charging roller 16 so that the charging roller 16 is spaced apart from the photosensitive drum 11 and thus the charging nip N2 is released, and at the charging position, the charging roller 16 contacts the photosensitive drum 11 so that the charging nip N2 is formed. For example, the second moving member 550 may be mounted at the first frame 101 so as to be rotatable between the non-charging position and the charging position.

The second moving member 550 may be located at the charging position when the photosensitive drum 11 and the developing roller 12 are located at the development position, and may be shifted to the non-charging position when the photosensitive drum 11 and the developing roller 12 are located at the non-development position. The second moving member 550 may be shifted between the charging position and the non-charging position by the driving member 510.

In the embodiment, an extending part 203 that extends to an inner side of the first frame 101 may be arranged at the second frame 201. The second lever portion 552 contacts the extending part 203. Due to an elastic force of a third elastic member 560, the second lever portion 552 may remain contacting the extending part 203. The third elastic member 560 applies, to the second moving member 550, the elastic force in a direction to the charging position.

The second lever portion 552 may be located while being slightly spaced apart from the extending part 203. In this case, a stopper (not shown) for allowing the second moving member 550 to remain at the charging position may be arranged at the first frame 101.

As illustrated in FIG. 14, when the photosensitive drum 11 and the developing roller 12 are located at the development position, the first moving member 500 is located at the first location. The second moving member 550 is located at the charging position, and the charging roller 16 remains contacting the photosensitive drum 11.

When the first moving member 500 is shifted from the first location to the second location by the driving member 510, the second frame 201 rotates in a direction B1 with respect to the hinge axis 301. Then, the extending part 203 pushes the second lever portion 552, and the second moving member 550 rotates to the non-charging position. The first lever portion 551 pushes the rotation axis 16*a* of the charging roller 16 so as to allow the charging roller 16 to be spaced apart from the photosensitive drum 11.

When the first moving member 500 arrives at the second location, as illustrated in FIG. 15, the second moving member 550 arrives at the non-charging position, and the charging roller 16 is spaced apart from the photosensitive drum 11.

In the state shown in FIG. 15, when the first moving member 500 returns to the first location, the second frame 201 rotates in a direction B2 with respect to the hinge axis 301, and the second moving member 550 is shifted to the charging position due to the elastic force of the third elastic member 560. The charging roller 16 is moved to the photosensitive drum 11 due to the elastic force of the second elastic member 130 and contacts the photosensitive drum 11.

According to the aforementioned configuration, the development nip N1 and the charging nip N2 may be simultaneously controlled by using the driving member 510.

Figure 16:
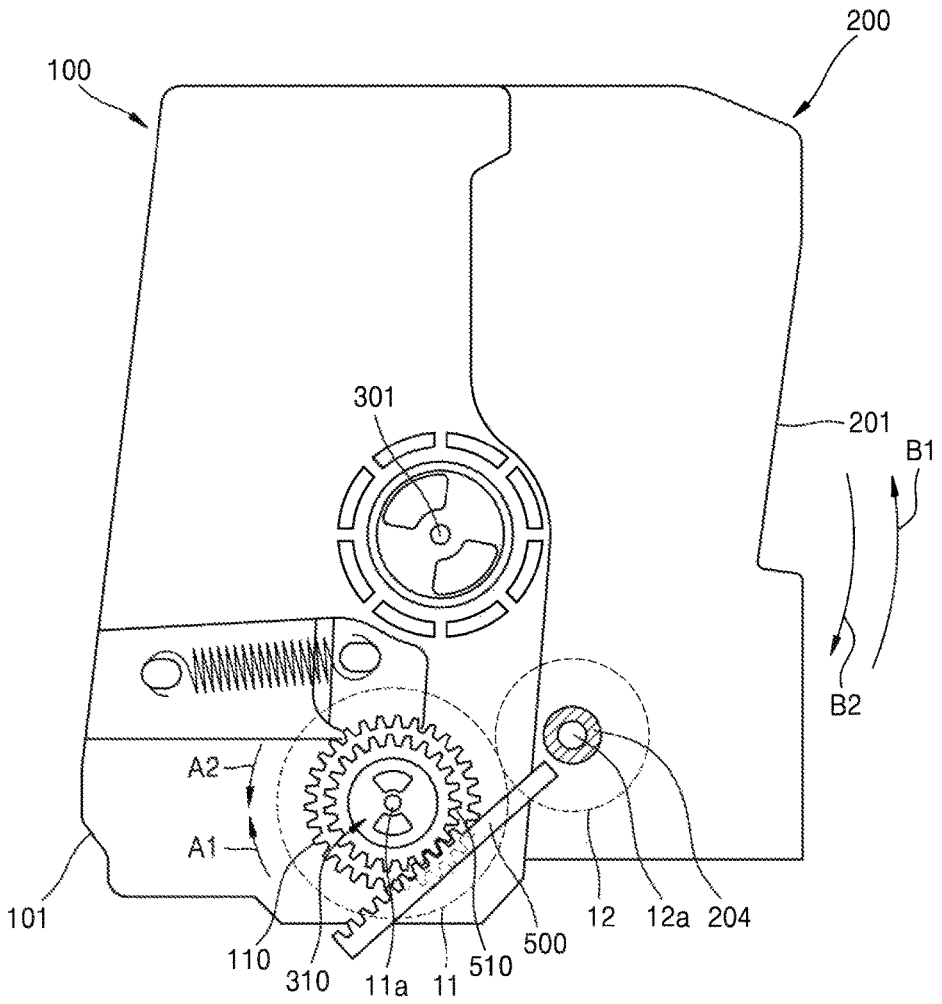
FIG. 16 is a diagram illustrating the development cartridge, according to an embodiment.

In the aforementioned embodiment, the first moving member 500 is mounted at the second frame 201, but the first moving member 500 may be mounted at the first frame 101. FIG. 16 is a diagram illustrating the development cartridge 10, according to an embodiment. Referring to FIG. 16, the first moving member 500 is mounted at the first frame 101 so as to be switched between the first location and the second location. The second frame 201 may include a contact part 204 that the first moving member 500 contacts when the first moving member 500 is shifted from the first location to the second location.

The driving member 510 is mounted on the rotation axis 11*a* of the photosensitive drum 11. The gear 110 is arranged at the coupler 320. The gear 110 functions as the driving gear 210 in the aforementioned embodiment. Therefore, hereinafter, the gear 110 is referred to as the driving gear 110. The driving gear 110 may be integrated with the coupler 320, or may be mounted on the rotation axis 11*a*, separately from the coupler 320.

For example the driving gear 110 may rotate together with the rotation axis 11*a*. In this case, selective power connection between the driving member 510 and the driving gear 110 may be realized by the one-way clutch structure shown in FIG. 6. In this case, the driving gear 210 in FIG. 6 may be the driving gear 110. In addition, the selective power connection between the driving member 510 and the driving gear 110 may be realized by the one-way clutch structure shown in FIG. 7.

In this case, the rotation axis 12*a* in FIG. 7 may be the rotation axis 11*a*. In addition, when the speed reducer is used, the driving gear 210 in FIG. 10 may be the driving gear 110. Also, the driving gear 110 may be connected to the driving member 510 by a planetary reducer. In this case, as shown in FIG. 7, the bush 210*d* may be arranged at the driving gear 110, and the sun gear 210*c* may be inserted into the bush 210*d* by having the clutch spring 530 arranged therebetween.

According to the aforementioned configuration, when the driving gear 110 rotates in the first direction A1 for a printing operation, the driving member 510 does not rotate, the first moving member 500 remains at the first location, and the photosensitive drum 11 and the developing roller 12 are located at the development position where the photosensitive drum 11 and the developing roller 12 contact each other.

When the driving gear 110 rotates in the second direction A2, the driving member 510 rotates together with the driving gear 110, and the first moving member 500 is switched from the first location to the second location. In this regard, the first moving member 500 pushes a part of the second frame 201, for example, the contact part 204, so as to rotate the second frame 201 in a direction B1 with respect to the hinge axis 301, that is, in a direction opposite to the elastic force of the elastic member 330. By doing so, the developing roller 12 becomes spaced apart from the photosensitive drum 11. When the first moving member 500 arrives at the second location, the photosensitive drum 11 and the developing roller 12 are located at the non-development position where the photosensitive drum 11 and the developing roller 12 are spaced apart from each other.

In this state, when the driving gear 110 rotates in the first direction A1, connection between the driving gear 110 and the driving member 510 is disconnected, and the driving member 510 may freely rotate. Due to the elastic force of the elastic member 330, the second frame 201 rotates with respect to the hinge axis 301 in a direction B2, and the first moving member 500 having pushed by the second frame 201 returns from the second location to the first location. The developing roller 12 returns to the development position where the developing roller 12 contacts the photosensitive drum 11, and then the developing roller 12 remains at the development position due to the elastic force of the elastic member 330.

Figure 17:
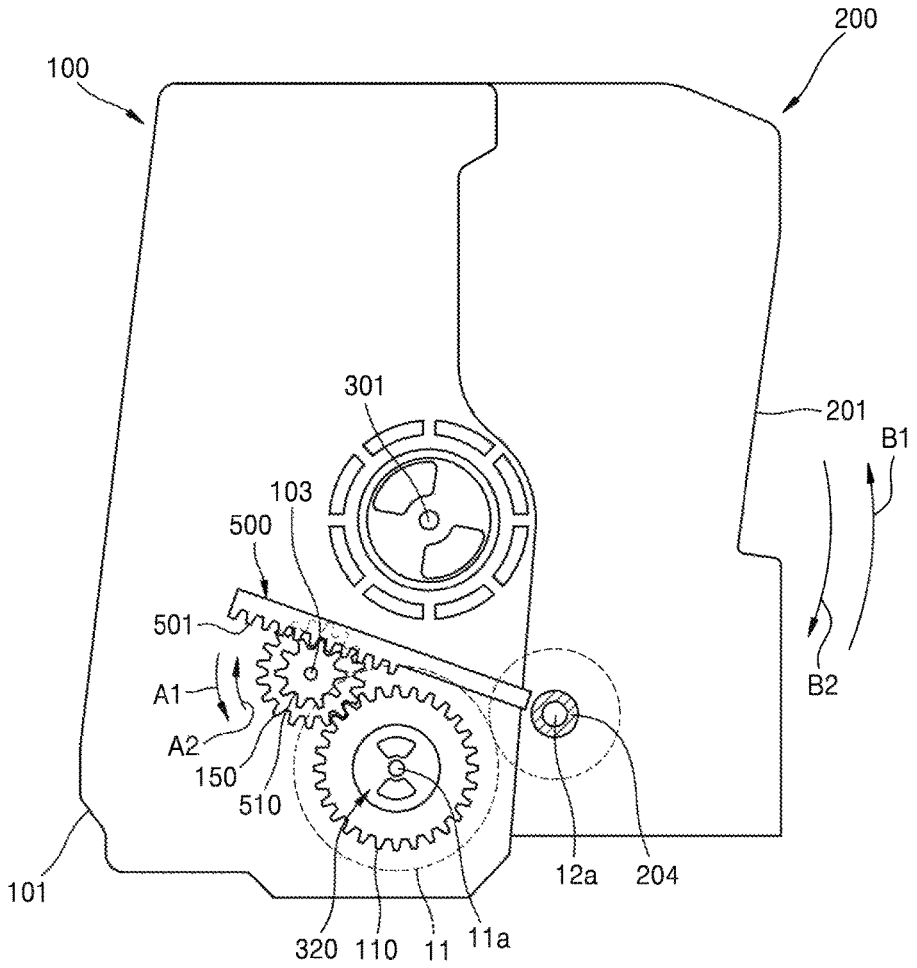
FIG. 17 is a diagram illustrating the development cartridge, according to an embodiment.

FIG. 17 is a diagram illustrating the development cartridge 10, according to an embodiment. Referring to FIG. 17, an axis 103 is mounted at the first frame 101. A driving gear 150 to be rotated by the coupler 320 is mounted on the axis 103. For example, the driving gear 150 is engaged with the gear 110. The driving member 510 is rotatably mounted on the axis 103.

Selective power connection between the driving member 510 and the driving gear 150 may be realized by the one-way clutch structure shown in FIG. 6. In this case, the driving gear 210 in FIG. 6 may be the driving gear 150. In addition, the selective power connection between the driving member 510 and the driving gear 150 may be realized by the one-way clutch structure shown in FIG. 7. In this case, the rotation axis 12*a* in FIG. 7 may be the axis 103. In addition, when the speed reducer is used, the driving gear 210 in FIG. 10 may be the driving gear 150.

Also, the driving gear 150 may be connected to the driving member 510 by the planetary reducer. In this case, as shown in FIG. 7, the bush 210*d* may be arranged at the driving gear 150, and the sun gear 210*c* may be inserted into the bush 210*d* by having the clutch spring 530 arranged therebetween.

According to the aforementioned configuration, when the driving gear 150 rotates in the first direction A1 for a printing operation, the driving member 510 does not rotate. Therefore, the first moving member 500 is located at the first location, and the photosensitive drum 11 and the developing roller 12 are located at the development position as shown in FIG. 2.

When the driving gear 150 rotates in the second direction A2, the driving member 510 rotates together with the driving gear 150. Then, the first moving member 500 is switched from the first location to the second location, and the second frame 201 rotates with respect to the hinge axis 301 in a direction opposite to the elastic force of the elastic member 330, so that the photosensitive drum 11 and the developing roller 12 are located at the non-development position where the photosensitive drum 11 and the developing roller 12 are spaced apart from each other.

In this state, when the driving gear 150 rotates in the first direction A1, the connection between the driving gear 150 and the driving member 510 is disconnected, and the driving member 510 may freely rotate. Due to the elastic force of the elastic member 330, the second frame 201 rotates with respect to the hinge axis 301 in a direction where the photosensitive drum 11 and the developing roller 12 contact each other, and the first moving member 500 rotates the driving member 510 in the first direction A1 and is shifted from the second location to the first location.

Although not illustrated, the structure of simultaneously controlling the development nip N1 and the charging nip N2 shown in FIGS. 14 and 15 may also be applied to the embodiments of FIGS. 16 and 17.

While this disclosure has been particularly shown and described with reference to the embodiments thereof, it will be understood by one of ordinary skill in the art that various changes in form and details may be made therein without departing from the spirit and scope of the disclosure as defined by the appended claims. The embodiments should be considered in a descriptive sense only and not for purposes of limitation. Therefore, the scope of the disclosure is defined not by the detailed description of the disclosure but by the appended claims, and all differences within the scope will be construed as being included in the disclosure.

What is claimed is:

1. A development cartridge for an image forming apparatus, the development cartridge comprising:

a photosensitive unit comprising a photosensitive drum;

a developing unit comprising a developing roller configured to contact the photosensitive drum so as to form a development nip, the developing unit coupled to the photosensitive unit to be rotatable;

a driving gear configured to drive at least one of the developing roller and the photosensitive drum, and configured to rotate in a first direction or a second direction opposite the first direction;

a driving member positioned coaxially with the driving gear and configured to be rotated by the driving gear;

a first one-way clutch configured to connect the driving member with the driving gear when the driving gear rotates in the second direction; and a first moving member configured to be connected to the driving member so as to move between a first location to rotate the developing unit to form the development nip and a second location to rotate the developing unit to release the development nip.

2. The development cartridge of claim 1, wherein the driving gear is configured to be rotated in the first direction during a printing operation, and the driving gear is configured to be rotated in the second direction during a non-printing operation.

3. The development cartridge of claim 2, wherein the driving member comprises pinion gear parts, and the first moving member comprises rack gear parts to be engaged with the pinion gear parts.

4. The development cartridge of claim 2, wherein, when the first moving member moves from the first location to the second location, the first moving member rotates the developing unit in a direction to cause the development nip to be released, and when the first moving member moves from the second location to the first location, the first moving member allows the developing unit to rotate in a direction to cause the development nip to be formed.

5. The development cartridge of claim 4, further comprising an elastic member configured to provide an elastic force by which the developing unit rotates to form the development nip, and wherein, when the driving gear rotates in the first direction, the first moving member moves from the second location to the first location due to the elastic force of the elastic member.

6. The development cartridge of claim 5, wherein the driving gear and the driving member are disposed at the development nip, and when the first moving member moves from the first location to the second location, the first moving member moves the photosensitive unit by contacting a contact part of the photosensitive unit.

7. The development cartridge of claim 5, wherein the driving gear and the first moving member are disposed at the photosensitive unit, and when the first moving member moves from the first location to the second location, the first moving member moves the developing unit by contacting a contact part of the developing unit.

8. The development cartridge of claim 2, wherein a speed reducer is disposed between the driving gear and the driving member.

9. The development cartridge of claim 8, wherein the speed reducer comprises a planetary reducer.

10. The development cartridge of claim 9, wherein the planetary reducer comprises a sun gear configured to be rotated by the driving gear, and a plurality of planet gears configured to be engaged with the sun gear and to be rotatably mounted at the driving member, and the driving gear and the sun gear are connected to each other by the first one-way clutch.

11. The development cartridge of claim 2, wherein the photosensitive unit comprises a first rotational member comprising the photosensitive drum, the developing unit comprises a second rotational member comprising the developing roller, and the driving gear and the driving member are mounted on a rotation axis of one of the first rotational member and the second rotational member.

12. The development cartridge of claim 2, wherein the driving gear is rotatably mounted on a rotation axis of the developing roller, and the development cartridge further comprises:

a driving bush coupled to the rotation axis of the developing roller; and a second one-way clutch configured to connect the driving gear with the driving bush when the driving gear rotates in the first direction.

13. The development cartridge of claim 2, wherein the photosensitive unit comprises a first rotational member comprising the photosensitive drum, the developing unit comprises a second rotational member comprising the developing roller, and the driving gear and the driving member are mounted on an axis other than rotation axes of the first rotational member and the second rotational member.

14. The development cartridge of claim 2, further comprising:

a charging roller configured to form a charging nip by contacting the photosensitive drum and to charge the photosensitive drum;

a second elastic member configured to apply an elastic force to the charging roller in a direction to cause the charging roller to contact the photosensitive drum; and a second moving member disposed at the photosensitive unit so as to be moved, by the driving member, between a charging position to form the charging nip and a non-charging position to space the charging roller apart from the photosensitive drum.

15. The development cartridge of claim 14, wherein the second moving member is configured to move from the charging position to the non-charging position when the first moving member is moved from the first location to the second location.

16. The development cartridge of claim 15, further comprising an extending part disposed at the developing unit and configured to move the second moving member to the non-charging position when the first moving member is moved from the first location to the second location.

17. The development cartridge of claim 16, further comprising a third elastic member configured to apply an elastic force to the second moving member in a direction to cause the second moving member to return to the charging position when the first moving member is moved from the second location to the first location.

18. An electrophotographic image forming apparatus, comprising:

a main body; and a development cartridge detachably attached to the main body, the development cartridge including:

a photosensitive unit comprising a photosensitive drum;

a developing unit comprising a developing roller configured to contact the photosensitive drum so as to form a development nip;

a driving gear configured to drive at least one of the developing roller and the photosensitive drum, and configured to rotate in a first direction or a second direction opposite the first direction;

a driving member positioned coaxially with the driving gear and configured to be rotated by the driving gear;

a first one-way clutch configured to connect the driving member with the driving gear when the driving gear rotates in the second direction; and a first moving member configured to be connected to the driving member so as to move between a first location to form the development nip and a second location to release the development nip.

19. The electrophotographic image forming apparatus of claim 18, further comprising:

a driving motor disposed at the main body and configured to drive the photosensitive drum and the developing roller; and a second one-way clutch disposed between the driving motor and the photosensitive drum so as to connect the driving motor with the photosensitive drum when the driving gear rotates in the first direction.

20. The electrophotographic image forming apparatus of claim 18, further comprising:

a first driving motor disposed at the main body and configured to drive the photosensitive drum; and a second driving motor disposed at the main body and configured to drive the developing roller.

* * * * *